US012523216B2

(12) United States Patent
Sun et al.

(10) Patent No.: US 12,523,216 B2
(45) Date of Patent: Jan. 13, 2026

(54) METHOD TO SMOOTH PUMP RATE WHILE FRACTURING

(71) Applicant: Halliburton Energy Services, Inc., Houston, TX (US)

(72) Inventors: Zhijie Sun, Houston, TX (US); Behrouz Ebrahimi, Houston, TX (US); Erik Lee, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 63 days.

(21) Appl. No.: 18/528,373

(22) Filed: Dec. 4, 2023

(65) Prior Publication Data

US 2025/0180006 A1 Jun. 5, 2025

(51) Int. Cl.

| | |
|---|---|
| ***F04B 49/02*** | (2006.01) |
| ***E21B 43/26*** | (2006.01) |
| ***F04B 23/04*** | (2006.01) |
| ***F04B 49/10*** | (2006.01) |
| ***F04B 49/20*** | (2006.01) |

(52) U.S. Cl.

CPC ..... *F04B 49/02* (2013.01); *F04B 23/04* (2013.01); *F04B 49/106* (2013.01); *F04B 49/20* (2013.01); *E21B 43/2607* (2020.05)

(58) Field of Classification Search

CPC ..... F04B 49/02; F04B 23/04; F04B 47/00; F04B 49/106; F04B 49/20; E21B 43/2607

See application file for complete search history.

(56) References Cited

U.S. PATENT DOCUMENTS

| | | | | |
|---|---|---|---|---|
| 10,794,168 | B2 | 10/2020 | Dykstra et al. | |
| 10,851,638 | B2 | 12/2020 | Payne et al. | |
| 11,649,817 | B2 | 5/2023 | Bagulayan et al. | |
| 11,649,820 | B2 | 5/2023 | Yeung et al. | |
| 2015/0252814 | A1* | 9/2015 | Nakahara | F24F 11/83 700/282 |
| 2016/0356127 | A1 | 12/2016 | Dykstra et al. | |
| 2017/0322086 | A1* | 11/2017 | Luharuka | E21B 44/00 |
| 2021/0040830 | A1* | 2/2021 | Mu | F04B 23/04 |
| 2022/0003229 | A1* | 1/2022 | Mu | F04B 47/02 |

* cited by examiner

*Primary Examiner* — Bryan M Lettman

(74) *Attorney, Agent, or Firm* — Michael Jenney; C. Tumey Law Group PLLC

(57) ABSTRACT

A method for controlling changes in pump flow rates. The method involves identifying a first plurality of pumps scheduled to go offline and calculating a corresponding total flow decrease rate. Additionally, a second plurality of pumps intended to go online is identified, and a total flow increase rate is calculated based on these pumps. A determination is then made as to whether the difference between the total flow decrease rate and the total flow increase rate exceeds a predetermined flow rate threshold. If the threshold is exceeded, pump throttling is implemented based on this determination to manage the change in flow rates.

20 Claims, 10 Drawing Sheets

PUMP DATA 240

| | PUMP IDENTIFIER 250 | PUMP TYPE 252 | PUMP STATUS 254 | FLOW RATE 130 | FLOW DECREASE RATE 264 | FLOW INCREASE RATE 266 |
|---|---|---|---|---|---|---|
| | | | | BPM | BPM/S | BPM/S |
| PUMP DATA ENTRY A 240A | DSL_80_A | DIESEL | ONLINE | 80 | 5 | 3 |
| PUMP DATA ENTRY B 240B | DSL_80_B | DIESEL | TO GO OFFLINE | 80 | 5 | 3 |
| PUMP DATA ENTRY C 240C | ELC_40_A | ELEC | TO GO ONLINE | 40 | 8 | 1 |
| PUMP DATA ENTRY D 240D | ELC_40_B | ELEC | TO GO ONLINE | 40 | 8 | 1 |
| PUMP DATA ENTRY E 240E | EMRGNCY_1 | DIESEL | OFFLINE | 80 | 7 | 6 |

*FIG. 4A*

PUMP TRANSITION DATA 244

| | PUMP(S) TO GO OFFLINE 270 | TOTAL FLOW DECREASE RATE 272 | PUMP(S) TO GO ONLINE 274 | TOTAL FLOW INCREASE RATE 276 | PUMP(S) TO THROTTLE 278 | MODIFIED FLOW RATE CHANGES 280 |
|---|---|---|---|---|---|---|
| | | BPM/S | | BPM/S | | BPM/S |
| PUMP TRANSITION DATA ENTRY A 245A | [DSL_80_B] | 5 | [ELC_40_A, ELC_40_B] | 2 | [DSL_80_B] | [2] |
| PUMP TRANSITION DATA ENTRY B 245B | [ELC_40_A, ELC_40_B] | 16 | [DSL_80_B] | 3 | [ELC_40_A, ELC_40_B] | [1.5, 1.5] |

*FIG. 4B*

METHOD TO SMOOTH PUMP RATE WHILE FRACTURING

BACKGROUND

The oil and gas industry may use boreholes as fluid conduits to access subterranean deposits of various fluids and minerals which may include hydrocarbons. A drilling operation may be utilized to construct the fluid conduits which are capable of producing hydrocarbons disposed in subterranean formations. Boreholes may be incrementally constructed as tapered sections, which sequentially extend into a subterranean formation.

In some environments, subterranean deposits are dispersed in shale formations. In such environments, a fracturing operation may be utilized to extract hydrocarbons from the subterranean deposits. Fracturing requires the use of fracturing fluids to create fractures, keep the fractures open, and collect the hydrocarbons in the shale formation. One or more pumps may be used to move the fracturing fluid in and out of the borehole.

BRIEF DESCRIPTION OF DRAWINGS

These drawings illustrate certain aspects of some examples of the present disclosure and should not be used to limit the disclosure.

FIG. 4A is a diagram of an example pump data table.

FIG. 4B is a diagram of an example pump transition data table.

DETAILED DESCRIPTION

—Overview and Advantages—

Figure 1A:
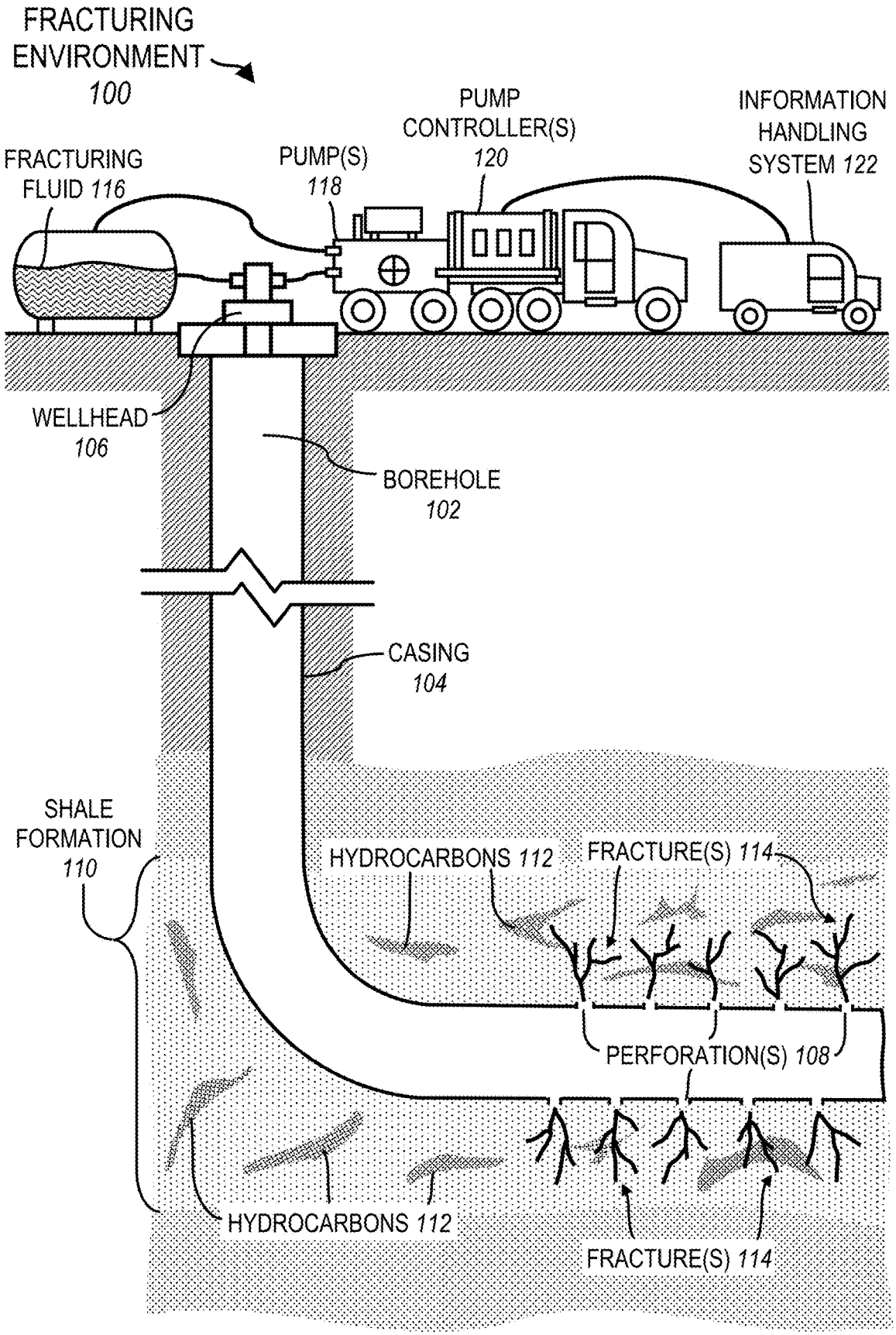
FIG. 1A is a diagram of an example fracturing environment.

In general, this application discloses one or more embodiments of methods and systems for controlling the changes in flow rate of pumps, in a multi-pump system, so that a relatively constant total flow rate is maintained when transitioning pumps. Such a system may be used in a fracturing environment for a pump system that controls the flow of fracturing fluid in a borehole.

In general, when a pump is initially powered on, the counteracting inertial forces of the fluid and the pump must be overcome. These forces include (i) the static friction of the moving parts of the pump, (ii) the friction of the fluid against any connected piping (and inside the pump), and (iii) the upstream weight of the fluid (i.e., the static "head" present at the pump's outlet). Accordingly, it requires some duration of time for the pump to achieve a steady-state flow against these always-present counteracting forces. Importantly, when the pump is powered off (i.e., power to the pump is abruptly cut), these same counteracting forces quickly deplete the momentum of the fluid's flow—more quickly than the pump requires to achieve steady-state flow rate when powering on.

Thus, when a pump "powers up", the flow rate increases at a slower rate than the decrease in flow rate when the pump "powers down". As an example, a pump that operates at 6 barrels per minute (BPM) may take 60 seconds to fully reach the maximum 6 BPM flow rate (i.e., increasing at 0.1 BPM/s for 60 seconds). However, when that same pump is powered off, it may take 5 seconds to drop to 0 GPM (i.e., decreasing at 1.2 BPM/s for 5 seconds).

Pumps, like most machinery, occasionally require inspection, maintenance, and/or repairs. In environments where nonstop flow is desired, multiple pump(s) are installed (in parallel) to provide a consistent total flow rate and allow for some pumps to be offline (thus avoiding service interruptions). However, in certain environments (e.g., fracturing) where it is desired to maintain the overall flow rate within a narrow range (e.g., with relatively close upper and lower thresholds), differing rates of change in the flow rate (when pumps are powered off and on) create undesirable variations in the total flow rate.

Continuing with the example above, consider two identical pumps, each with a 6 BPM flow rate (with a 0.1 BPM/s flow increase rate and a 1.2 BPM/s flow decrease rate) configured in parallel. Further, the larger system (in which the pumps are installed) requires a minimum total flow rate of 5 BPM and cannot exceed a maximum total flow rate of 7 BPM.

In such a system, if an operation first pump is powered off at the same time an offline second pump is powered on, the total flow rate will drop (for the first 5 seconds) from 6 BPM to 0.5 BPM. That is, the second pump will only gain 0.5 BPM in the same duration that the first pump loses all 6 BPM of flow rate. Accordingly, the required minimum flow rate of 5 BPM is not maintained.

Alternatively, the second pump may be powered on in advance of powering off the first pump. In such a case, the second pump may be powered on for 10 seconds (simultaneously with the first pump) thereby increasing the total flow rate to 7 BPM (the maximum allowable flow rate). Once at 7 BPM, the first pump may be powered off to prevent the total flow rate from exceeding the maximum allowable flow rate (of 7 BPM). However, 2 seconds after powering off the first pump, the total flow rate will drop to 4.8 BPM (below the minimum allowable flow rate of 5 GPM) before continuing to drop down to 1.5 BPM over the subsequent 3 seconds.

In one or more embodiments herein, system and methods are described for throttling the decrease (or, possibly the increase) in pump flow rate of pumps in order to maintain a (relatively) constant total flow rate. That is, continuing with the example above, instead of abruptly cutting power to the first pump, power to the first pump may be gradually reduced in order to maintain a flow decrease rate equal to the flow increase rate of the second pump. Further, such a system may be applicable to any systems with two or more pumps operating simultaneously (e.g., five pumps may be powered on to replace the decreasing flow rate of three pumps being powered off).

Further, the changes in flow rate may be dynamic throughout the transition. As an example, if multiple pumps are powering on at different flow increase rates, one (or more) of those pumps may achieve their maximum flow rate while others continue to increase their flow rate (at a slower rate, for a longer duration of time). Accordingly, the pumps being powered down may be throttled at different rates, during the transition process, to match any changes in the total flow increase rate provided by the pumps powering on.

—FIG. 1A—

FIG. 1A is a diagram of an example fracturing environment. Fracturing environment 100 may include one or more pump(s) 118 (controlled by one or more pump controller(s) 120) that pump fracturing fluid 116 into borehole 102 (through wellhead 106) to extract hydrocarbons 112 from shale formation 110 via fracture(s) 114. Each of these components is described below.

Borehole 102 is a hole in the ground which may be formed by a drillstring (and one or more components thereof) to access subterranean resource deposits. Borehole 102 may be partially or fully lined with casing 104. Further, wellhead 106 may be installed between the surface and borehole 102 to provide control and separation of the contents of borehole 102.

Casing 104 is concrete and/or metal lining that separates borehole 102 from the surrounding ground. Casing 104 may be used to protect the surrounding ground from the contents of borehole 102, and conversely, to protect borehole 102 from the surrounding ground. In fracturing environment 100, casing 104 may be constructed to withstand pressures greater than casings 104 installed in a drilling environment.

Wellhead 106 is a machine which may include one or more pipes, caps, and/or valves to provide pressure control for contents within borehole 102. In any embodiment, wellhead 106 may be equipped with a blowout preventer (not shown) to prevent the flow of higher-pressure fluids (in borehole 102) from escaping to the surface in an uncontrolled manner. Wellhead 106 may be equipped with other ports and/or sensors to monitor pressures within borehole 102 and/or otherwise facilitate drilling and/or fracturing operations.

Perforations 108 are small holes created in casing 104 to allow fracturing fluid 116 to flow into shale formation 110. In any embodiment, perforations 108 may be created by a perforating gun (not shown) and/or other machine to puncture the walls of casing 104. Perforations 108 may be made in any direction in shale formation 110 that allows for the extraction of hydrocarbons 112.

Shale formation 110 is a sedimentary rock layer which is composed of mud, silt, and clay. Shale formation 110 may be formed when layers of mud and silt are deposited in the earth, oceans, lakes, and/or rivers. Over time, the weight of the overlying sediment compresses the mud and silt, forming shale. Shale formation 110 is often found in layers, with other sedimentary rocks, such as sandstone and limestone. Shale formation 110 is typically very thin, ranging from a few inches to a few feet in thickness. However, shale formation 110 may be thicker, with some formations reaching thicknesses of over 1,000 feet. In any embodiment, Shale formation 110 may be a source of hydrocarbons 112.

Hydrocarbons 112 are a resource (e.g., oil and/or natural gas) formed from organic matter within shale formation 110. Hydrocarbons 112 may be dispersed within shale formation 110 and not easily accessible. Consequently, extracting hydrocarbons 112 from shale formation 110 may be achieved via hydraulic fracturing (e.g., through fracture(s) 114 created in shale formation 110).

Fracture 114 is a planar crack in shale formation 110 which is created by pumping fracturing fluid 116 into shale formation 110 at high pressure. Fracture 114 begins at perforation 108 (through casing 104 of borehole 102). Fracture 114 may be several hundred feet long and several inches wide. They can also be complex, with multiple branches and extensions.

Fracturing fluid 116 is a mixture of liquid(s) and/or solids which may be pumped through borehole 102 to create fracture(s) 114 and collect hydrocarbons 112. In any embodiment, fracturing fluid 116 is typically a mixture of water, proppant, and chemical additives. Water in fracturing fluid 116 may be used to transmit the pressure to shale formation 110 and create fracture(s) 114. A proppant (e.g., sand, ceramic beads) keeps fracture(s) 114 open after fracturing fluid 116 is withdrawn from borehole 102. Chemical additives may be used to improve the performance of fracturing fluid 116 by reducing friction and preventing loss of viscosity. In any embodiment, fracturing fluid 116 is pumped (i.e., via pump(s) 118) down borehole 102 and through perforation(s) of casing 104 into shale formation 110. The pressure created by fracturing fluid 116 exceeds the tensile strength of the rocks in shale formation 110, causing the rocks to split and create fracture(s) 114. Consequently, fracturing fluid 116 is forced into fracture(s) 114, and the proppant keeps fracture(s) 114 open after fracturing fluid 116 is withdrawn.

Pump 118 is a machine that may be used to circulate fracturing fluid 116 from a tank to the interior of borehole 102 (e.g., through one or more port(s) on wellhead 106). Pump 118 may be of any type (e.g., centrifugal, gear, etc.) and powered by any suitable means (e.g., electricity, combustible fuel, etc.). In any embodiment, pump(s) 118 may be connected to pump controller(s) 120 which, in turn, operatively connect to information handling system 122. In such a configuration, information handling system 122 may control pump(s) 118 (e.g., initiate powering off, powering on, throttling, etc.) via pump controller(s) 120. In any embodiment, pump 118 may be mounted and transported on an automotive vehicle (e.g., a truck) for transportation to and from fracturing environment 100. Pumps 118 may be configured into pump system 126 (see description for FIG. 1B).

Pump controller 120 is a hardware computing device that may control one or more pump(s) 118. In any embodiment, pump controller 120 may control the flow of electrical power (e.g., voltage, current) to pump(s) 118 and/or control the flow of fuel (e.g., via a choke, any valve) to pump(s) 118. In turn, pump controller 120 may control the rotational speed, torque, power, torque, and/or flow rate of pump(s) 118.

Information handling system 122 is a hardware computing device which may be utilized to perform various steps, methods, and techniques disclosed herein (e.g., via the execution of software). In any embodiment, information handling system 122 may include one or more processor(s), cache, memory, storage, and/or one or more peripheral device(s). Any two or more of these components may be operatively connected via a system bus that provides a means for transferring data between those components. Information handling system 122 may be operatively connected to pump controller(s) 120 (and/or other various components of fracturing environment 100). In any embodiment, information handling system 122 may utilize any suitable form of wired and/or wireless communication to send and/or receive data to and/or from other components of fracturing environment 100 (e.g., to control one or more pump(s) 118 via pump controller(s) 120). In any embodiment, information handling system 122 may receive a digital telemetry signal, demodulate the signal, display data (e.g., via a visual output device), and/or store the data. Additional details regarding information handling system 122 may be found in the description of FIG. 2A.

—FIG. 1B—

Figure 1B:
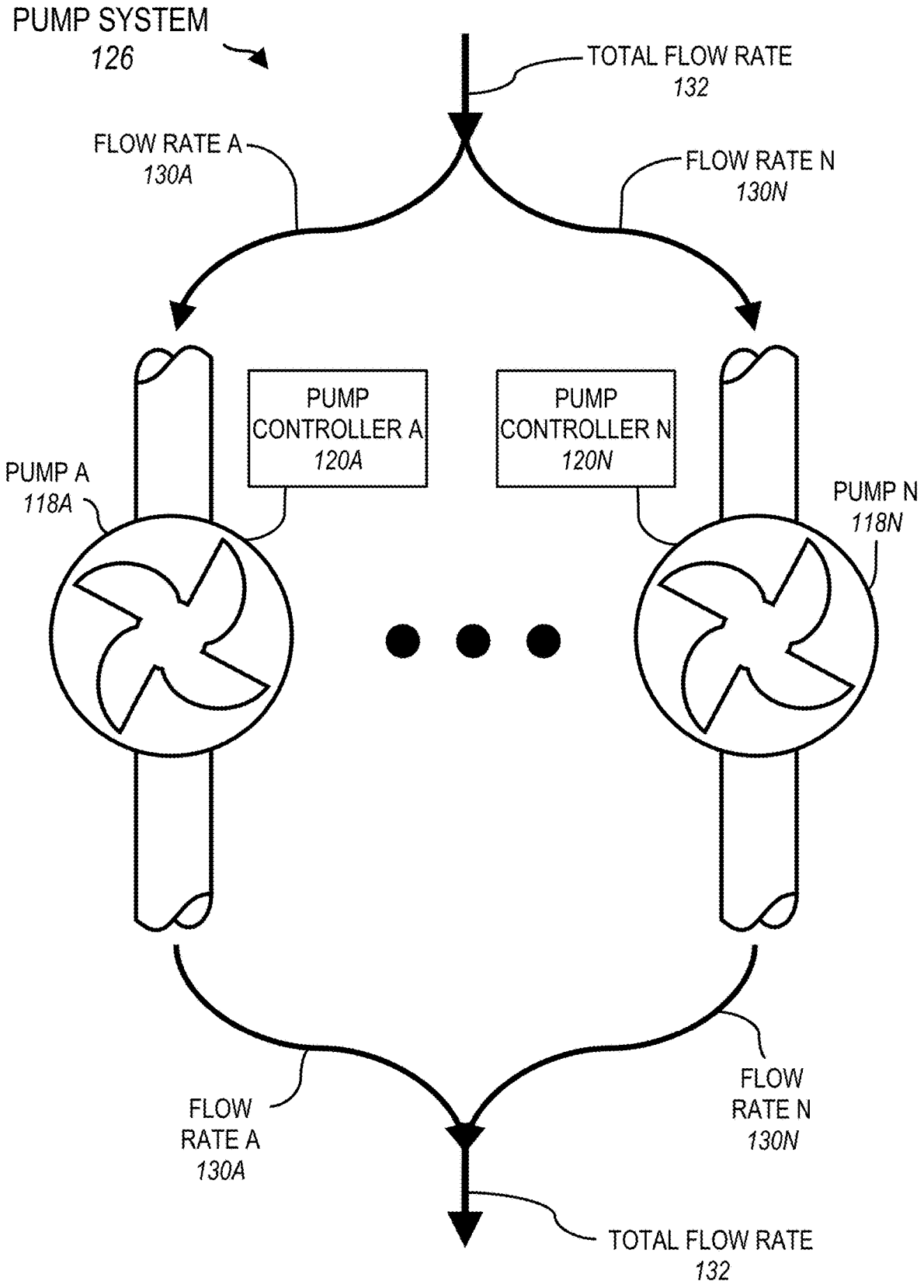
FIG. 1B is a diagram of an example pump system.

FIG. 1B is a diagram of an example pump system. Pump system 126 may include one or more pump(s) 118, each with a respective flow rates 130.

In pump system 126, two or more pumps 118 may be configured into a "parallel" (as shown in FIG. 1B), where two or more pumps 118 pull a fluid from the same source and output that fluid to the same destination. In any embodiment, two or more pumps 118 may be configured into a "series" pump system 126 (not shown) where pumps 118 are attached so that the output from one pump 118 feeds the input of another pump 118. Additionally, in any embodiment, three or more pumps 118 may be configured into a hybrid system where pumps 118 are configured into a combination of a "parallel" and "series" systems (e.g., two pumps in "series" may be configured to operate in "parallel" with at least one other pump, configured in "series").

In any "parallel" pump system 126, pumps 118 may be interchangeable, with pumps 118 going online and offline for varying reasons. As a non-limiting example, in FIG. 1B, pump A 118A is a pump that is designed and configured to operate at flow rate A 130A, for the broader system. Further, pump N 118N is pump that sits powered off and idle while pump A 118A is operating. Then, if pump A 118A is powered off (or otherwise fails for any reason), pump N 118N may be powered on to provide the same (or similar) flow rate N 130N as flow rate A 130A (e.g., via pump controller N 120N).

Flow rate 130 is the volumetric flow rate (e.g., measured in volume per time) of a fluid (e.g., fracturing fluid 116) flowing through a respective pump 118. In any embodiment, flow rate 130 (for a corresponding pump 118) may be relatively constant when pump 118 is operating at full power. Additionally, flow rate 130 may be variable by controlling the power provided to pump 118. In any embodiment, when pump 118 is not provided with any power (e.g., is powered off), flow rate 130 may be at 0 (or approaching 0, if recently powered off). Further, when pump 118 is powering up, flow rate 130 may increase from 0 to a maximum and/or otherwise controlled flow rate 130.

Total flow rate 132 is the combined volumetric flow rate (e.g., measured in volume per unit time) of a fluid (e.g., fracturing fluid 116) flowing through pump system 126. In pump systems 126 with only a single pump 118, total flow rate 132 will be equal to the flow rate 130 associated with that the single pump 118. In pump systems 126 with two or more pumps 118, connected only in "series", total flow rate 132 will be equal to the flow rate 130 for any of the individual pumps 118 in the system. In pump systems 126 with two or more pumps 118 configured in "parallel", total flow rate 132 is equal to the sum of the flow rates 130 for each line of parallel pump(s) 118.

—FIG. 2A—

Figure 2A:
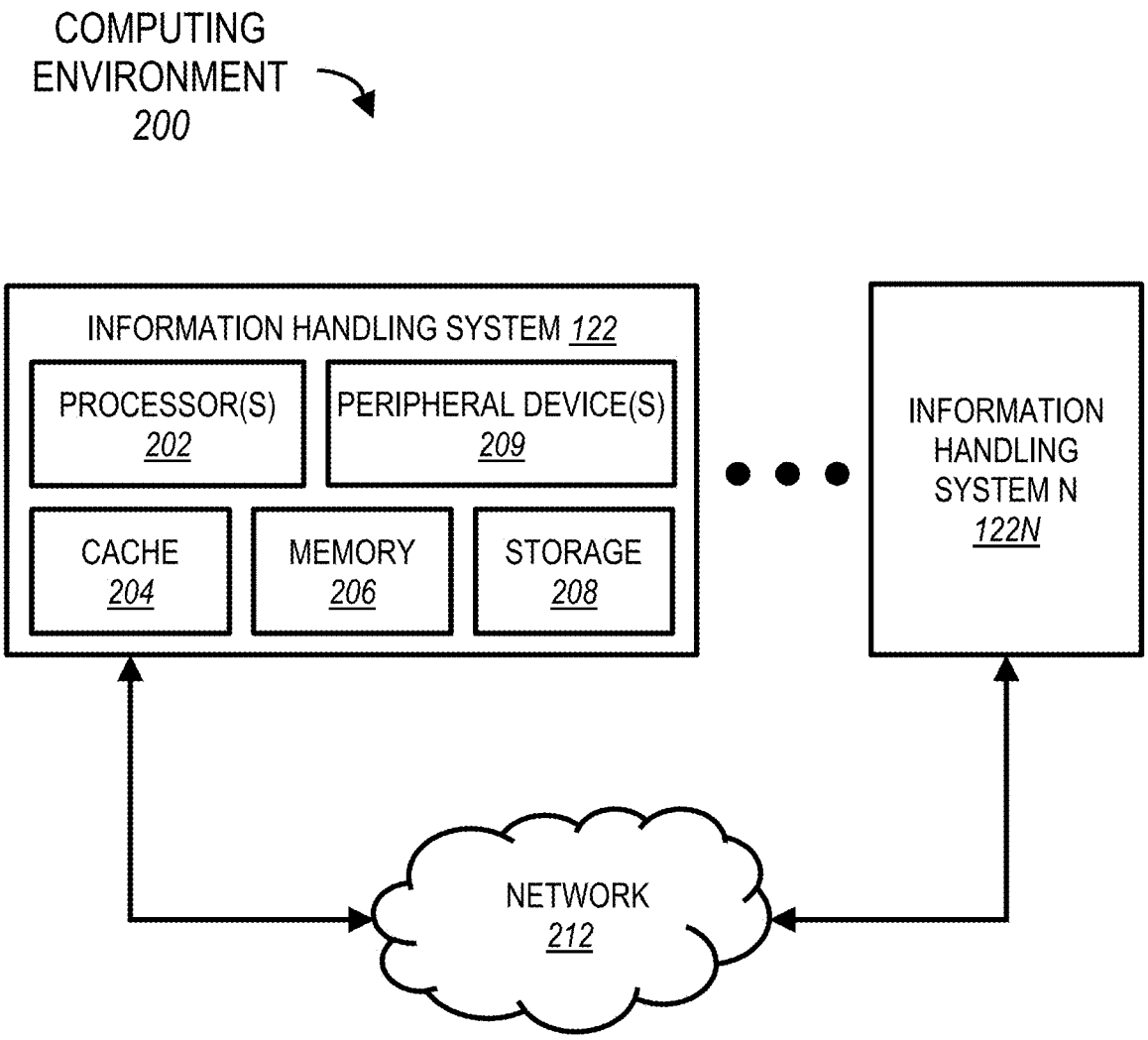
FIG. 2A is a diagram of an example computing environment.

FIG. 2A is a diagram of an example computing environment. Computing environment 200 may include one or more information handling system(s) 122 connected via network 212. Each of these components is described below.

Information handling system 122 is a hardware computing device which may be utilized to perform various steps, methods, and techniques disclosed herein (e.g., via the execution of software). In any embodiment, information handling system 122 may include one or more processor(s) 202, cache 204, memory 206, storage 208, and/or one or more peripheral device(s) 209. Any two or more of these components may be operatively connected via a system bus (not shown) that provides a means for transferring data between those components. Although each component is depicted and disclosed as individual functional components, these individual components may be combined (or divided) into any combination or configuration of components.

A system bus is a system of hardware connections (e.g., sockets, ports, wiring, conductive tracings on a printed circuit board (PCB), etc.) used for sending (and receiving) data to (and from) each of the components connected thereto. In any embodiment, a system bus allows for communication via an interface and protocol (e.g., inter-integrated circuit (I2C), peripheral component interconnect (express) (PCI(e)) fabric, etc.) that may be commonly recognized by the components utilizing the system bus. In any embodiment, a basic input/output system (BIOS) may be configured to transfer information between the components using the system bus (e.g., during initialization of information handling system 122).

In any embodiment, information handling system 122 may additionally include internal physical interface(s) (e.g., serial advanced technology attachment (SATA) ports, peripheral component interconnect (PCI) ports, PCI express (PCIe) ports, next generation form factor (NGFF) ports, M.2 ports, etc.) and/or external physical interface(s) (e.g., universal serial bus (USB) ports, recommended standard (RS) serial ports, audio/visual ports, etc.). Internal physical interface(s) and external physical interface(s) may facilitate the operative connection to one or more peripheral device(s) 209.

Non-limiting examples of information handling system 122 include a general purpose computer (e.g., a personal computer, desktop, laptop, tablet, smart phone, etc.), a network device (e.g., switch, router, multi-layer switch, etc.), a server (e.g., a blade-server in a blade-server chassis, a rack server in a rack, etc.), a controller (e.g., a programmable logic controller (PLC)), and/or any other type of computing device with the aforementioned capabilities. Further, information handling system 122 may be operatively connected to another information handling system 122 via network 212 in a distributed computing environment. As used herein, a "computing device" may be equivalent to an information handling system.

Processor 202 is a hardware device which may take the form of an integrated circuit configured to process computer-executable instructions (e.g., software). Processor 202 may execute (e.g., read and process) computer-executable instructions stored in cache 204, memory 206, and/or storage 208. Processor 202 may be a self-contained computing system, including a system bus, memory, cache, and/or any other components of a computing device. Processor 202 may include multiple processors, such as a system having multiple, physically separate processors in different sockets, or a system having multiple processor cores on a single physical chip. A multi-core processor may be symmetric or asymmetric. Multiple processors 202, and/or processor cores thereof, may share resources (e.g., cache 204, memory 206) or may operate using independent resources.

Non-limiting examples of processor 202 include general-purpose processor (e.g., a central processing unit (CPU)), an application specific integrated circuit (ASIC), a programmable gate array (PGA), a field programmable gate array (FPGA), a digital signal processor (DSP), and any digital or analog circuit configured to perform operations based on input data (e.g., execute program instructions).

Cache 204 is one or more hardware device(s) capable of storing digital information (e.g., data) in a non-transitory medium. Cache 204 expressly excludes transitory media (e.g., transitory waves, energy, carrier signals, electromagnetic waves, signals per se, etc.). Cache 204 may be considered "high-speed", having comparatively faster read/write access than memory 206 and storage 208, and therefore utilized by processor 202 to process data more quickly than data stored in memory 206 or storage 208. Accordingly, processor 202 may copy needed data to cache 204 (from memory 206 and/or storage 208) for comparatively speedier access when processing that data. In any embodiment, cache 204 may be included in processor 202 (e.g., as a subcomponent). In any embodiment, cache 204 may be physically independent, but operatively connected to processor 202.

Memory 206 is one or more hardware device(s) capable of storing digital information (e.g., data) in a non-transitory medium. Memory 206 expressly excludes transitory media (e.g., transitory waves, energy, carrier signals, electromagnetic waves, signals per se, etc.). In any embodiment, when accessing memory 206, software (executed via processor 202) may be capable of reading and writing data at the smallest units of data normally accessible (e.g., "bytes"). Specifically, memory 206 may include a unique physical address for each byte stored thereon, thereby enabling the ability to access and manipulate (read and write) data by directing commands to a specific physical address associated with a byte of data (i.e., "random access"). Non-limiting examples of memory 206 devices include flash memory, random access memory (RAM), dynamic RAM (DRAM), static RAM (SRAM), resistive RAM (ReRAM), read-only memory (ROM), and electrically erasable programmable ROM (EEPROM). In any embodiment, memory 206 devices may be volatile or non-volatile.

Storage 208 is one or more hardware device(s) capable of storing digital information (e.g., data) in a non-transitory medium. Storage 208 expressly excludes transitory media (e.g., transitory waves, energy, carrier signals, electromagnetic waves, signals per se, etc.). In any embodiment, the smallest unit of data readable from storage 208 may be a "block" (instead of a "byte"). Prior to reading and/or manipulating the data on storage 208, one or more block(s) may be copied to an intermediary storage medium (e.g., cache 204, memory 206) where the data may then be accessed in "bytes" (e.g., via random access). In any embodiment, data on storage 208 may be accessed in "bytes" (like memory 206). Non-limiting examples of storage 208 include integrated circuit storage devices (e.g., a solid-state drive (SSD), Non-Volatile Memory Express (NVMe), flash memory, etc.), magnetic storage devices (e.g., a hard disk drive (HDD), floppy disk, magnetic tape, diskette, cassettes, etc.), optical media (e.g., a compact disc (CD), digital versatile disc (DVD), etc.), and printed media (e.g., barcode, quick response (QR) code, punch card, etc.).

As used herein, "non-transitory computer readable medium" is cache 204, memory 206, storage 208, and/or any other hardware device capable of non-transitorily storing and/or carrying data.

Peripheral device 209 is a hardware device configured to send (and/or receive) data to (and/or from) information handling system 122 via one or more internal and/or external physical interface(s). Any peripheral device 209 may be categorized as one or more "types" of computing devices (e.g., an "input" device, "output" device, "communication" device, etc.). However, such categories are not comprehensive and are not mutually exclusive. Such categories are listed herein strictly to provide understandable groupings of the potential types of peripheral devices 209. As such, peripheral device 209 may be an input device, an output device, a communication device, and/or any other optional computing component.

An input device is a hardware device that receives data into information handling system 122. In any embodiment, an input device may be a human interface device which facilitates user interaction by collecting data based on user inputs (e.g., a mouse, keyboard, camera, microphone, touchpad, touchscreen, fingerprint reader, joystick, gamepad, etc.). In any embodiment, an input device may collect data based on raw inputs, regardless of human interaction (e.g., any sensor, logging tool, audio/video capture card, etc.). In any embodiment, an input device may be a reader for accessing data on a non-transitory computer readable medium (e.g., a CD drive, floppy disk drive, tape drive, scanner, etc.).

An output device is a hardware device that sends data from information handling system 122. In any embodiment, an output device may be a human interface device which facilitates providing data to a user (e.g., a visual display monitor, speakers, printer, status light, haptic feedback device, etc.). In any embodiment, an output device may be a writer for facilitating storage of data on a non-transitory computer readable medium (e.g., a CD drive, floppy disk drive, magnetic tape drive, printer, etc.).

A communication device is a hardware device capable of sending and/or receiving data with one or more other communication device(s) (e.g., connected to another information handling system 122 via network 212). A communication device may communicate via any suitable form of wired interface (e.g., Ethernet, fiber optic, serial communication etc.) and/or wireless interface (e.g., Wi-Fi® (Institute of Electrical and Electronics Engineers (IEEE) 802.11), Bluetooth® (IEEE 802.15.1), etc.) and utilize one or more protocol(s) for the transmission and receipt of data (e.g., transmission control protocol (TCP), user datagram protocol (UDP), internet protocol (IP), remote direct memory access (RDMA), etc.). Non-limiting examples of a communication device include a network interface card (NIC), a modem, an Ethernet card/adapter, and a Wi-Fi® card/adapter.

An optional computing component is any hardware device that operatively connects to information handling system 122 and extends the capabilities of information handling system 122. Non-limiting examples of an optional computing components include a graphics processing unit (GPU), a data processing unit (DPU), and a docking station.

As used herein, "software" (e.g., "code", "algorithm", "application", "routine") is data in the form of computer-executable instructions. Processor 202 may execute (e.g., read and process) software to perform one or more function(s). Non-limiting examples of functions may include reading existing data, modifying existing data, generating new data, and using any capability of information handling system 122 (e.g., reading existing data from memory 206, generating new data from the existing data, sending the generated data to a GPU to be displayed on a monitor). Although software physically persists in cache 204, memory 206, and/or storage 208, one or more software instances may be depicted, in the figures, as an external component of any information handling system 122 that interacts with one or more information handling system(s) 122.

Network 212 is a collection of connected information handling systems (e.g., 122, 122N) that allows for the exchange of data and/or the sharing of computing resources therebetween. Non-limiting examples of network 212 include a local area network (LAN), a wide area network (WAN) (e.g., the Internet), a mobile network, any combination thereof, and any other type of network that allows for the communication of data and sharing of resources among computing devices operatively connected thereto. A person of ordinary skill in the relevant art, having the benefit of this detailed description, would appreciate that a network is a collection of operatively connected computing devices that enables communication between those computing devices.

—FIG. 2B—

Figure 2B:
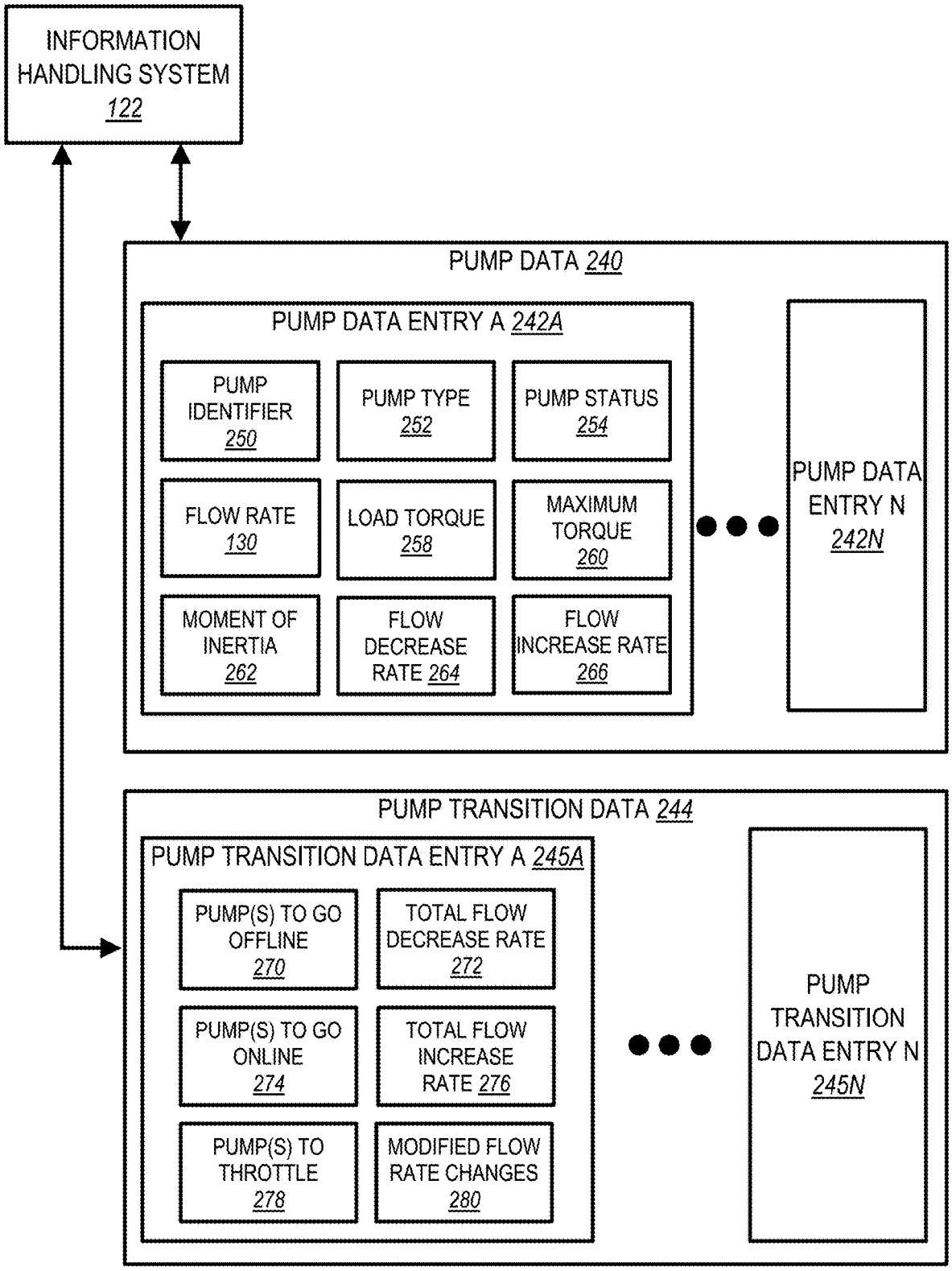
FIG. 2B is a diagram of data structures and an information handling system.

FIG. 2B is a diagram of data structures and an information handling system. Pump data 240 and/or pump transition data 244 may be created, accessed, modified, and/or otherwise maintained by information handling system 122.

Pump data 240 is a data structure that includes one or more pump data entries 242. In any embodiment, each pump data entry 242 includes information related to a single individual pump 118 (uniquely associated with pump identifier 250). Pump data entry 242 may include pump identifier 250, pump type 252, pump status 254, flow rate 130, load torque 258, maximum torque 260, moment of inertia 262, flow decrease rate 264, and flow increase rate 266.

Pump identifier 250 is data which provides a unique identification of a single pump 118 (e.g., a tag, an alphanumeric entry, a filename, a row number in table, etc.). An alphanumeric expression may be encoded using a standard protocol for alphanumeric characters (e.g., Unicode, American Standard Code for Information Interchange (ASCII), etc.). In any embodiment, pump identifier 250 may be provided by a user that initiated the creation of the corresponding pump data entry 242. In any embodiment, pump identifier 250 may be automatically generated by information handling system 122 when pump data entry 242 is created. Further, pump identifier 250 may be an integer count (e.g., 1, 2, 3, 4, 5, etc.) or index (e.g., 0, 1, 2, 3, etc.). One of ordinary skill in the art, having the benefit of this detailed description, would appreciate that pump identifier 250 may be any data that uniquely identifies an associated pump 118 and/or pump data entry 242.

Pump type 252 is data which provides a form of power provided to the associated pump 118. Pump type 252 may be an alphabetic string (e.g., "electric", "diesel") and/or an integer (e.g., "0", "1", etc.), where each integer is associated with some type of power method (e.g., "0" means "diesel", "8" means "gasoline", etc.).

Pump status 254 is data which provides the current state of the associated pump 118 and/or a planned future state of the associated pump 118. Pump status 254 may be a string which provides human readable information about the pump's state (e.g., "online", "active", "on", "running", "offline", "stopped", "off", "to go offline", "to go online", "needs service", etc.). In any embodiment, pump status 254 may be an integer (e.g., "0", "1", etc.), where each integer is associated with some type of status (e.g., "0" means "off", "1" means "on", "3" means "to go offline", "9" means "needs service", etc.).

Load torque 258 is data which provides the torque input to the pump (e.g., input work, instantaneous power) applied to the associated pump 118 (e.g., via a motor). In any embodiment, load torque 258 may be obtained from known specifications of the associated pump 118 (e.g., the data sheet), measured directly from the associated pump 118 (e.g., via a torque sensor, strain gauge, etc.), and/or calculated using other properties of the associated pump 118 (e.g., load torque 258=flow rate 130×pressure difference between pump inlet and out/rotation speed of motor shaft).

Maximum torque 260 is data which provides the maximum torque that can be produced by the rotating shaft of the engine, motor, and/or transmission that powers the associated pump 118. In any embodiment, maximum torque 260 may be obtained from known specifications of the associated pump 118 (e.g., the data sheet), measured directly from the associated pump 118, and/or calculated using the engine's torque map and calculating the transmission ratio of any transmission attached thereto.

Moment of inertia 262 is data which provides the magnitude of torque needed to achieve a desired angular acceleration of the associated pump 118.

Flow decrease rate 264 is data which provides the negative rate of change in flow rate 130 of the associated pump 118, when power is abruptly cut to the associated pump 118. When a pump 118 is powered off (e.g., the motor of the pump is turned off), existing counteracting forces cause the pump 118 to lose momentum and slow to a stop. These counteracting forces include (i) the friction of the moving parts of the pump, (ii) the friction of the fluid against any connected piping (and inside the pump), and (iii) the upstream weight of the fluid (i.e., the static "head" present at the pump's outlet). Flow decrease rate 264 is measured in volume per unit time-squared, however units of time may be dissimilar (e.g., barrels-per-minute-per-second BPM/s)

Flow increase rate 266 is data which provides the positive rate of change in flow rate 130 of the associated pump 118, when the associated pump 118 is powering on. When a pump is initially provided with power, all of the counteracting forces of the fluid must be overcome to begin pumping the fluid (e.g., frictional forces, gravitational forces, etc.). Flow increase rate 266 may depend on the multiple factors of the associated pump 118, including pump type 252, (maximum) flow rate 130, the amount of power provided (e.g., 10 kW vs 100 KW), load torque 258, and/or the counteracting forces.

Pump transition data 244 is a data structure that includes one or more pump transition data entries 245. In any embodiment, each pump transition data entry 245 includes information related to a process for powering off one or more pump(s) 118 and powering on one or more pump(s) 118. Pump transition data entry 245 may include pump(s) to go offline 270, total flow decrease rate 272, pump(s) to go online 274, total flow increase rate 276, pump(s) to throttle 278, and modified flow rate changes 280.

Pump(s) to go offline 270 is data which provides a set and/or list of one or more pump identifier(s) 250, where each pump identifier 250 is in a pump data entry 242 that also includes a pump status 254 of "to go offline" (or similar pump status 254). As a non-limiting example, if there are two pump data entries 242, each with pump type 252 of "to go offline", both of the pump identifiers 250 would be listed in pump(s) to go offline 270. As there may be multiple entries in pump(s) to go offline 270, pump(s) to go offline 270 may be an array of values separated by some character (e.g., comma separated, tab separated, line separated, etc.) to distinguish between each pump identifier 250 therein.

Total flow decrease rate 272 is data which provides the sum of the flow decrease rate(s) 264 of the pump(s) 118 associated with the pump identifier(s) listed in pump(s) to go offline 270. As a non-limiting example, if four pump identifiers 250 are listed in pump(s) to go offline 270, each flow decrease rate 264 associated with those pump identifiers 250 (i.e., in the same pump data entry 242) are summed together to generate total flow decrease rate 272.

Pump(s) to go online 274 is data which provides a set and/or list of one or more pump identifier(s) 250, where each pump identifier 250 is in a pump data entry 242 that also includes a pump status 254 of "to go online" (or similar pump status 254). As a non-limiting example, if there are three pump data entries 242, each with pump type 252 of "to go online", the three pump identifiers 250 would be listed in pump(s) to go online 274. As there may be multiple entries in pump(s) to go online 274, pump(s) to go online 274 may be an array of values separated by some character (e.g., comma separated, tab separated, line separated, etc.) to distinguish between each pump identifier 250 therein.

Total flow increase rate 276 is data which provides the sum of the flow increase rate(s) 266 of the pump(s) 118 associated with the pump identifier(s) listed in pump(s) to go online 274. As a non-limiting example, if four pump identifiers 250 are listed in pump(s) to go online 274, each flow increase rate 266 associated with those pump identifiers 250 (i.e., in the same pump data entry 242) are summed together to generate total flow increase rate 276.

Pump(s) to throttle 278 is data which provides a set and/or list of one or more pump identifier(s) 250, where each pump identifier 250 is associated with a pump 118 that will have their flow decrease rate 264 or flow increase rate 266 throttled (during power down, or power up, respectively). Pump(s) 118 listed in pump(s) to throttle 278 may be added by information handling system 122 based on a difference in magnitude of total flow decrease rate 272 and total flow increase rate 276.

Modified flow rate changes 280 is data which provides the rate of change of the flow rates 130 to be controlled during a transition of pump(s) 118 (i.e., one or more pump(s) 118 powering off while one or more pump(s) 118 power on). In any embodiment, modified flow rate changes 280 may include the change in flow rate 130 (i.e., a modified flow decrease rate or modified flow increase rate) for each pump identifier 250 listed in pump(s) to throttle 278. Further, there may be multiple changes in flow rate 130 associated with a single pump identifier 250, for different time periods of pump transition. That is, a single pump identifier 250 may be associated with two or more specified values, within modified flow rate changes 280, for controlling the change in flow rate 130 during a transition of pumps.

—FIGS. 3A-B—

Figure 3A:
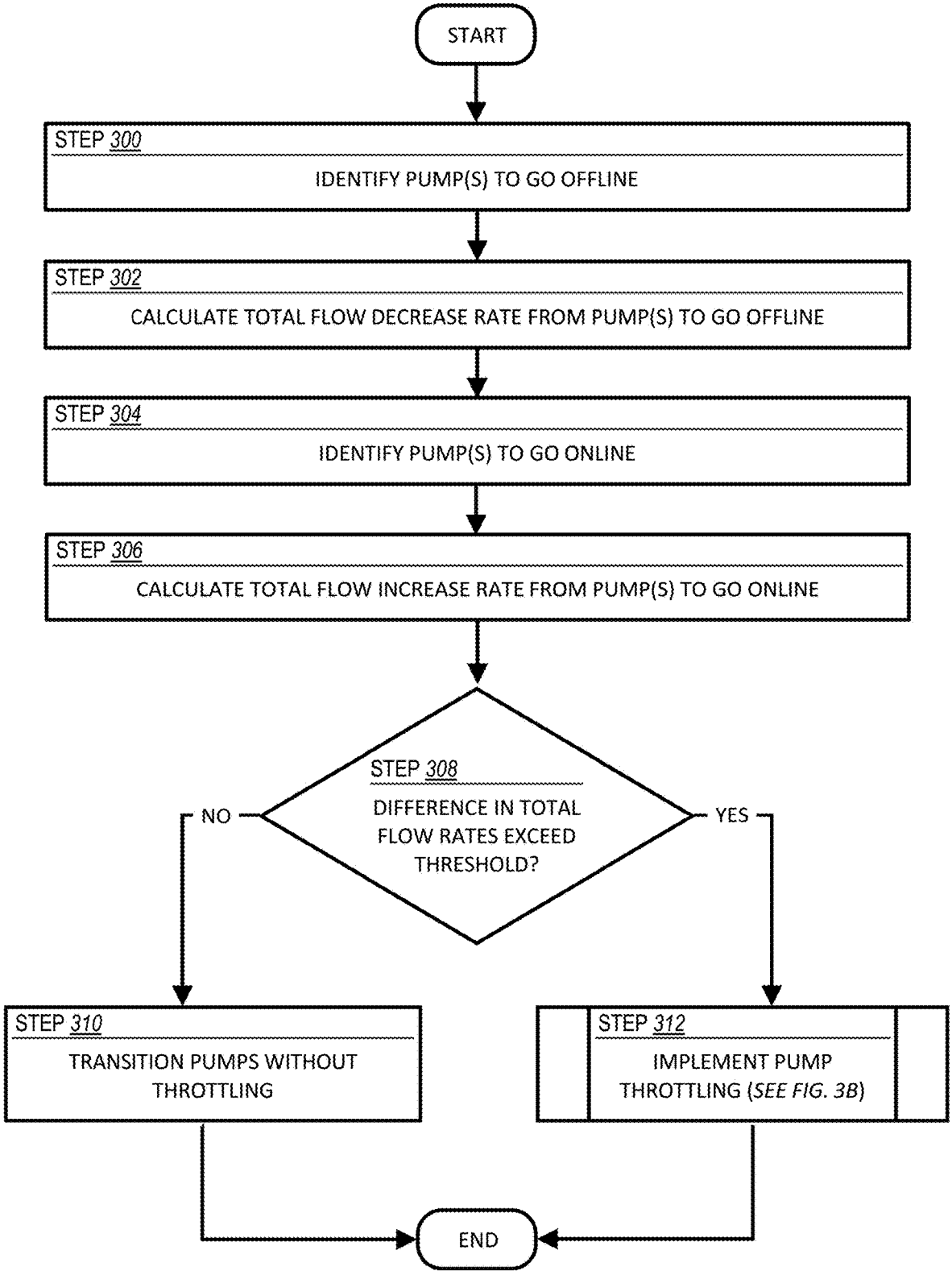
FIG. 3A is a flowchart of a method for transitioning active pumps using pump data.
Figure 3B:
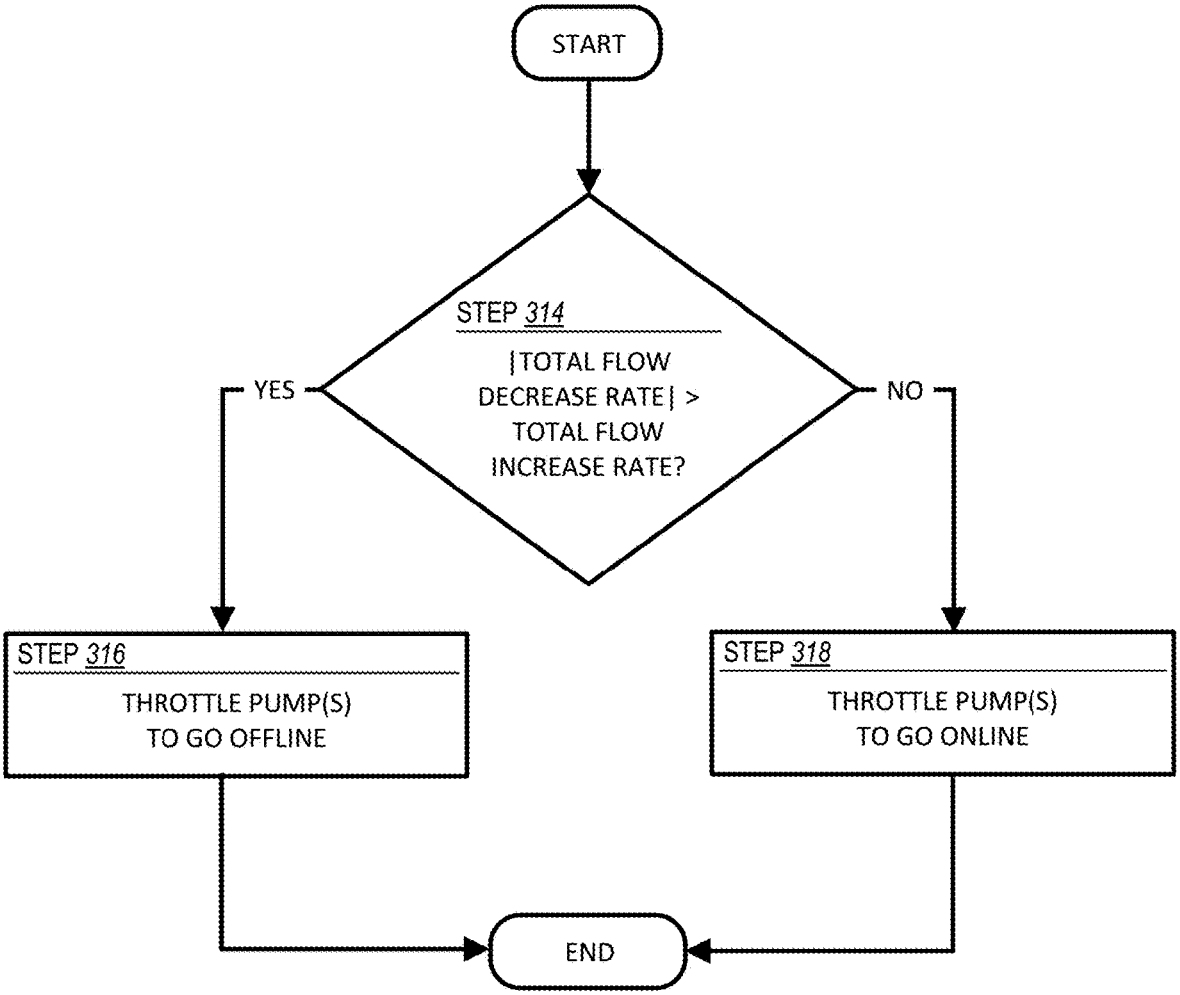
FIG. 3B is a flowchart for implementing a pump throttling procedure.

FIG. 3A is a flowchart of a method for transitioning active pumps using pump data. FIG. 3B is a flowchart for implementing a pump throttling procedure. All or a portion of the methods shown may be performed by one or more components of information handling system 122 (see description in FIG. 2A) or a user thereof. While the various steps in this flowchart are presented and described sequentially, one of ordinary skill in the relevant art (having the benefit of this detailed description) would appreciate that some or all steps may be executed in different orders, combined, or omitted, and some or all steps may be executed in parallel.

In step 300, information handling system 122 identifies one or more pump(s) 118 that are designated to go offline. In any embodiment, if an unprocessed pump transition data entry 245 already exists, information handling system 122 performs a lookup of pump(s) to go offline 270 and reads each of the pump identifier(s) 250 specified therein.

In any embodiment, if an unprocessed pump transition data entry 245 does not exist, information handling system 122 may perform a lookup in pump data 240 and search each pump data entry 242 for a pump status 254 therein that specifies "to go offline" (or any similar pump status 254). If information handling system 122 identifies one or more pump data entries 242 with a pump status 254 of "to go offline", information handling system 122 may (or add to an existing) pump transition data entry 245 (in pump transition data 244) and include a list of pump identifier(s) 250 (associated with a pump status 254 of "to go offline") in the pump(s) to go offline 270 field.

In step 302, information handling system 122 calculates total flow decrease rate 272 based on the pump identifier(s) 250 specified in pump(s) to go offline 270. In any embodiment, information handling system 122 performs a lookup and identifies each of the pump data entries 242 associated with pump identifier(s) 250 (specified in pump(s) to go offline 270) and sums each of the associated flow decrease rate(s) 264 (from each of the identified pump data entries 242) to calculate total flow decrease rate 272.

In step 304, information handling system 122 identifies one or more pump(s) 118 that are designated to go online. In any embodiment, if an unprocessed pump transition data entry 245 already exists, information handling system 122 performs a lookup of pump(s) to go online 274 and reads each of the pump identifier(s) 250 specified therein.

In any embodiment, if an unprocessed pump transition data entry 245 does not exist, information handling system 122 may perform a lookup in pump data 240 and search each pump data entry 242 for a pump status 254 therein that specifies "to go online" (or any similar pump status 254). If information handling system 122 identifies one or more pump data entries 242 with a pump status 254 of "to go online", information handling system 122 may create (or add to an existing) pump transition data entry 245 (in pump transition data 244) and include a list of pump identifier(s) 250 (associated with a pump status 254 of "to go online") in the pump(s) to go online 274 field.

In step 306, information handling system 122 calculates total flow increase rate 276 based on the pump identifier(s) 250 specified in pump(s) to go online 274. In any embodiment, information handling system 122 performs a lookup and identifies each of the pump data entries 242 associated with pump identifier(s) 250 (specified in pump(s) to go online 274) and sums each of the associated flow increase rate(s) 266 (from each of the identified pump data entries 242) to calculate total flow increase rate 276.

In step 308, information handling system 122 makes a determination if the difference between (the magnitude of) the total flow decrease rate 272 and (the magnitude of) the total flow increase rate 276 exceeds a flow rate threshold. If the determination is made that the difference in total flow rate changes does not exceed the threshold (step 308—NO), the method proceeds to step 310. If the determination is made that the difference in total flow rate changes exceeds the threshold (step 308—YES), the method proceeds to step 312.

In step 310, information handling system 122 proceeds to transition the pump(s) 118 specified in the pump transition data entry 245 without any throttling. In any embodiment, the total flow rate 132 would be relatively unaffected by the pump transition due to the relatively similar magnitude of the of the total flow decrease rate 272 and total flow increase rate 276 (within the flow threshold). Accordingly, information handling system 122 does not need to implement any modified flow rate changes 280.

In step 312, information handling system 122 implements pump throttling of the either the pump(s) to go offline 270 or the pump(s) to go online 274. Additional details regarding step 312 may be found in the description of steps 314, 316, and 318 (FIG. 3B).

In step 314, information handling system 122 makes a determination if the difference if (the magnitude of) the total flow decrease rate 272 is greater than (the magnitude of) the total flow increase rate 276. If the determination is made that (the magnitude of) the total flow decrease rate 272 is not greater than (the magnitude of) the total flow increase rate 276 (step 314—NO), the method proceeds to step 318.

In step 316, information handling system 122 identifies that the pump(s) 118 listed in pump(s) to go offline 270 are the pump(s) to throttle 278. Accordingly, information handling system 122 copies the pump identifier(s) 250 from pump(s) to go offline 270 to pump(s) to throttle 278 (and/or otherwise designates the pump(s) to go offline 270 as pump(s) to throttle 278).

Further, information handling system 122 generates modified flow rate changes 280 for each of the pump(s) 118 listed in pump(s) to go offline 270. Specifically, information handling system 122 produces a schedule of flow rate 130 changes that ensure the total flow rate 132 of the pump system remains constant during the pump transition. That is, as a non-limiting example, information handling system 122 produces a modified flow rate changes 280 that mirror the flow increase rate(s) 266 of the pump(s) to go online 274.

Sometime after modified flow rate changes 280 is generated, information handling system 122 sends commands to transition (and/or otherwise control) the pump(s) 118 as specified in the pump transition data entry 245 (i.e., powering down the pump(s) 118 specified in pump(s) to go offline 270 per modified flow rate changes 280 while simultaneously powering on the pump(s) 118 specified in pump(s) to go online 274). Information handling system 122 may control the increase or decrease in flow rate 130 of a pump 118 by sending one or more command(s) to a pump controller operatively connected to the pump 118. Further, information handling system 122 may control changes in flow rate 130 based on pump type 252 (e.g., controlling the flow of gasoline/diesel fuel, controlling the electrical power, etc.).

In step 318, information handling system 122 identifies that the pump(s) 118 listed in pump(s) to go online 274 are the pump(s) to throttle 278. Accordingly, information handling system 122 copies the pump identifier(s) 250 from pump(s) to go online 274 to pump(s) to throttle 278 (and/or otherwise designates the pump(s) to go online 274 as pump(s) to throttle 278).

Further, information handling system 122 generates modified flow rate changes 280 for each of the pump(s) 118 listed in pump(s) to go online 274. Specifically, information handling system 122 produces a schedule of flow rate 130 changes that ensure the total flow rate 132 of the pump system remains constant during the pump transition. That is, as a non-limiting example, information handling system 122 produces a modified flow rate changes 280 that mirror the flow decrease rate(s) 264 of the pump(s) to go offline 270.

Sometime after modified flow rate changes 280 is generated, information handling system 122 sends commands to transition (and/or otherwise control) the pump(s) 118 as specified in the pump transition data entry 245 (i.e., powering down the pump(s) 118 specified in pump(s) to go offline 270 while simultaneously powering on the pump(s) 118 specified in pump(s) to go online 274 per modified flow rate changes 280). Information handling system 122 may control the increase or decrease in flow rate 130 of a pump 118 by sending one or more command(s) to a pump controller operatively connected to the pump 118. Further, information handling system 122 may control changes in flow rate 130 based on pump type 252 (e.g., controlling the flow of gasoline/diesel fuel, controlling the electrical power, etc.).

—FIGS. 4A-B—

FIG. 4A is a diagram of an example pump data table. FIG. 4B is a diagram of an example pump transition data table. The example of FIGS. 4A-B is to illustrate the various processes and determinations, as depicted and discussed in FIG. 3A and FIG. 3B. The examples depicted in FIGS. 4A-B do not preclude the use of such methods for more complex implementations. One of ordinary skill in the art, having the benefit of this detailed description, would appreciate that pump data 240 and pump transition data 244 may include many more (or fewer) rows than shown. Accordingly, the rows included in FIGS. 4A-B are to provide examples which correlate to varying determinations in the process of FIG. 3A and FIG. 3B. Further, to avoid cluttering the examples, only certain pump data 240 is depicted (as columns) in FIG. 4A. The inclusion of only some pump data 240 does not preclude the existence of other (non-depicted) pump data 240 (e.g., load torque 258, moment of inertia 262, etc.).

For the pump data 240 shown in the table of FIG. 4A, there are five pump data entries 242 for five unique pumps 118 in a pump system. For the purposes of this example, assume all five pumps 118 are connected in parallel to a common reservoir at their inlet and a common pipe at their outlet. Further, each value provided for flow decrease rate 264 and total flow decrease rate 272 is shown as a positive number (i.e., the magnitude of the decrease).

During normal operations, two pumps 118 ("DSL_80_A" and "DSL_80_B") simultaneously operate to each provide 80 barrels per minute (BPM) of flow rate 130 (for 160 BPM of total flow rate 132). Additionally, there are two smaller pumps 118, labeled with pump identifiers 250 as "ELC_40_A" and "ELC_40_B". Each of the smaller pumps 118 has a flow rate 130 of 40 BPM. Thus, when operating in parallel, both smaller pumps 118 produce a combined flow rate 130 of 80 BPM (equal to that of a single "DSL_80" pump). Lastly, there is an emergency backup fifth pump 118 labeled with pump identifier 250 as "EMRGNCY_1". The emergency backup pump has a flow rate 130 of 80 BPM (equal to that of a single "DSL_80" pump).

Pump 118 with pump identifier 250 of "DSL_80_A" has pump status 254 of "ONLINE". Pump 118 with pump identifier 250 of "EMRGNCY_1" has pump status 254 of "OFFLINE". Pump 118 with pump identifier 250 "DSL_80_B" has pump status 254 of "TO GO OFFLINE", indicating that the associated pump 118 is to be shutdown. Conversely, both smaller pumps 118 ("ELC_40_A" and "ELC_40_B") have a pump status 254 of "TO GO ONLINE", indicating that both associated pumps are to be powered on.

Due to the existence of pump status(es) 254 indicating pumps 118 are "TO GO OFFLINE" and/or "TO GO ONLINE", information handling system 122 creates pump transition data entry A 245A in pump transition data 244. Each pump data entry 242 with pump status 254 of "TO GO OFFLINE" has the corresponding pump identifier 250 added to the pump(s) to go offline 270 field of pump transition data entry A 245A (i.e., "DSL_80_B", shown as a single entry in a bracketed array). Conversely, each pump data entry 242 with pump status 254 of "TO GO ONLINE" has the corresponding pump identifier 250 added to the pump(s) to go online 274 field of pump transition data entry A 245A (i.e., "ELC_40_A" and "ELC_40_B", shown as two entries in a comma-separated and bracketed array).

The "DSL_80_B" pump 118 has a flow decrease rate 264 of 5 BPM per second (BPM/s). Accordingly, if powered off when operating at full flow rate 130 (80 BPM), the associated pump 118 will lose all flow in 16 seconds (80 BPM/5 BPM/s=16 s). As "DSL_80_B" is the only pump 118 in pump(s) to go offline 270, total flow decrease rate 272 is the same as flow decrease rate 264 for "DSL_80_B" (i.e., 5 BPM/s).

Each "ELEC_40" pump 118 has a flow increase rate 266 of 1 BPM/s. In turn, total flow increase rate 276 is the summation of each flow increase rate 266 for each pump 118 specified in pump(s) to go online 274 ("ELC_40_A" and "ELC_40_B"). Thus, for pump transition data entry A 245A, total flow increase rate 276 is 2 BPM/s (1 BPM/s+1 BPM/s=2 BPM/s). Accordingly, if powered on, both smaller pumps 118, acting in parallel, would take 40 seconds to reach the maximum combined flow rate of 80 BPM (80 BPM/2 BPM/s=40 s).

Information handling system 122 makes a first determination that (for pump transition data entry A 245A) a difference between total flow decrease rate 272 (5 BPM/s) and total flow increase rate 276 (2 BPM/s) (i.e., a difference of 3 BPM/s) is greater than a threshold (e.g., 10%). Thus, pump throttling must be implemented to maintain a (relatively) constant total flow rate 132 when pumps 118 are being powered on and off simultaneously.

Information handling system 122 makes a second determination (for pump transition data entry A 245A) that total flow decrease rate 272 (5 BPM/s) is greater than total flow increase rate 276 (2 BPM/s). Thus, the pump(s) 118 specified in pump(s) to go offline 270 ("DSL_80_B") must be throttled. Accordingly, for pump transition data entry A 245A, information handling system 122 sets pump(s) to throttle 278 to the pump(s) 118 specified in pump(s) to go offline 270 (i.e., "DSL_80_B").

Further, information handling system 122 creates modified flow rate changes 280 (for pump transition data entry A 245A) that sets a modified flow decrease rate of 2 BPM/s (shown as a single entry in a bracketed array) respectively associated with each pump 118 specified in pump(s) to throttle 278. As the total flow increase rate 276 is 2 BPM/s, and pump(s) to throttle 278 only includes a single pump 118 (i.e., "DSL_80_B"), the modified flow rate changes 280 is set to 2 BPM/s for "DSL_80_B". Thus, when powering down "DSL_80_B", the flow rate 130 from the associated pump 118 will decrease at a rate of 2 BPM/s which will equal the total flow increase rate 276 (2 BPM/s, which is equal to the combined flow rate increase rate 266 from each of the two smaller pumps 118 of 1 BPM/s). When implemented, "DSL_80_B" will then take 40 seconds to fully power down (instead of 16 seconds), during which the two smaller pumps 118 will provide an equal magnitude increase in flow rate 130 to counteract the decrease in flow rate 130 of the "DSL_80_B" pump 118, thereby providing a more constant total flow rate 132 during the transition.

At some point later, both smaller pumps 118 have their respective pump statuses 254 changed to "TO GO OFFLINE" (not shown) and "DSL_80_B" has its respective pump status 254 changed to "TO GO ONLINE" (not shown). Thus, in turn, information handling system 122 creates pump transition data entry B 245B to handle the transition of pumps 118.

For pump(s) to go offline 270 (of pump transition data entry B 245B) both "ELC_40_A" and "ELC_40_B" are specified in a comma-separated and bracketed array. Each "ELC_40" pump 118 has a flow decrease rate 264 of 8 BPM/s, creating a total flow decrease rate 272 of 16 BPM/s. Accordingly, if powered off when operating at full flow rate 130 (80 BPM), each associated pump 118 will lose all flow in 5 seconds (80 BPM/16 BPM/s=5 s). As "DSL_80_B" is the only pump 118 in pump(s) to go online 274, total flow increase rate 276 is the same as flow increase rate 266 for "DSL_80_B" (i.e., 3 BPM/s).

Information handling system 122 makes a first determination that (for pump transition data entry B 245B) a difference between total flow decrease rate 272 (16 BPM/s) and total flow increase rate 276 (3 BPM/s) (i.e., a difference of 13 BPM/s) is greater than a threshold (e.g., 10%). Thus, pump throttling must be implemented to maintain a (relatively) constant total flow rate 132 when pumps 118 are being powered on and off simultaneously.

Information handling system 122 makes a second determination (for pump transition data entry B 245B) that total flow decrease rate 272 (16 BPM/s) is greater than total flow increase rate 276 (3 BPM/s). Thus, the pump(s) 118 specified in pump(s) to go offline 270 ("ELC_40_A" and "ELC_40_B") must be throttled. Accordingly, for pump transition data entry B 245B, information handling system 122 sets pump(s) to throttle 278 to the pump(s) 118 specified in pump(s) to go offline 270 (i.e., "ELC_40_A" and "ELC_40_B").

Further, information handling system 122 creates modified flow rate changes 280 (for pump transition data entry B 245B) that sets a modified flow decrease rate of 1.5 BPM/s and 1.5 BPM/s (shown as two entries in a comma-separated and bracketed array) respectively associated with each pump 118 specified in pump(s) to throttle 278 ("ELC_40_A" and "ELC_40_B").

The sum of modified flow rate changes 280 (i.e., 1.5 BPM/s+1.5 BPM/s) for each of the pump(s) to throttle 278 is set to be equal to the total flow increase rate 276 (3 BPM/s). Thus, when powering down "ELC_40_A" and "ELC_40_B", the flow rate 130 from the associated pumps 118 will decrease at a rate of 3 BPM/s (combined) which will equal the total flow increase rate 276 from "DSL_80_B" (3 BPM/s). When implemented, "DSL_80_B" will take (approximately) 26.7 seconds to fully reach a flow rate 130 of 80 BPM (80 BPM/3 BPM/s≈26.7 s), during which the two smaller pumps 118 will be slowly powered down (at 1.5 BPM/s each) to provide an equal magnitude decrease in flow rate 130 to match the increase in flow rate 130 (of the "DSL_80_B" pump 118). Accordingly, a more constant total flow rate 132 is maintained during the transition.

—FIG. 5A—

Figure 5A:
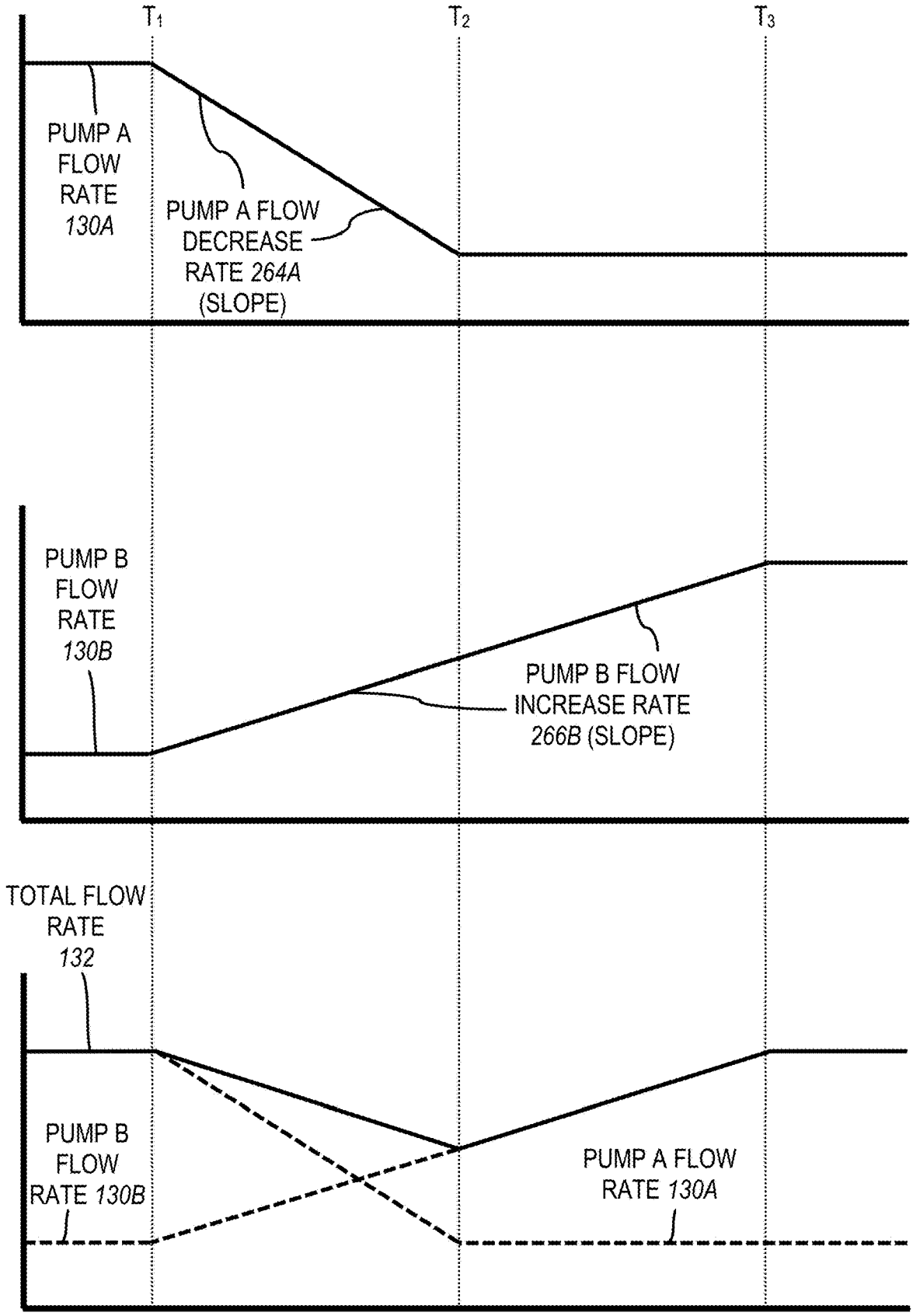
FIG. 5A is three charts of example flow rates for a conventional pump system.

FIG. 5A is three charts of example flow rates for a conventional pump system. For each depicted chart, the horizontal axis represents time, and the vertical axis represents flow rate 130. Each of the charts shows one or more pump(s) change in flow rate 130 over the same time period (the horizontal axis) and are only separated vertically for clarity (as different charts).

In the example of FIG. 5A, consider a scenario where pump A (corresponding to the top chart) is powered down while pump B (corresponding to the middle chart) is powered on. Pump A and pump B both have the same maximum flow rate 130, and pump B will be used to replace the flow rate provided by pump A.

The upper-most chart shows flow rate 130A for pump A. Initially (from the vertical axis to $T_1$), flow rate 130A is constant. At $T_1$, power is abruptly stopped and no longer provided to pump A. As power is no longer provided, lingering momentum allows pump A to continue pumping fluid as frictional resistances counteract that motion. Accordingly, between $T_1$ and $T_2$, the flow rate 130 A undergoes flow decrease rate 264A, as pump A stops producing any flow of the fluid. Accordingly, from $T_2$ onward, pump A does not produce any further flow rate 130 (i.e., flow rate 130A equals 0).

The middle chart shows flow rate 130B for pump B. Initially (from the vertical axis to $T_1$), flow rate 130B is constant. At $T_1$, power is provided to pump B. As frictional forces, gravity of the upstream fluid, and stationary momentum of the fluid have to be overcome, pump B begins to increase flow rate 130B at flow increase rate 266B. Notably, the magnitude of the slope of flow increase rate 266B is smaller than the magnitude of flow decrease rate 264A (the slope is not as steep). Consequently, pump B does not achieve full flow rate 130B until $T_3$. And from $T_3$ onward, pump B is at full flow rate B and fully replaced flow rate 130A of pump A.

The bottom chart shows the total flow rate 132 of the pump system over time. Initially (from the vertical axis to $T_1$), total flow rate 132 is constant (being provided exclusively by pump A flow rate 130A). At $T_2$, when the power is cut to pump A and power is provided to pump B, total flow rate 132 begins to drop. Total flow rate 132 does not drop as quickly as pump A flow rate 130A as pump B flow rate 130B provides increasing flow during the transition. However, as pump A flow decrease rate 264A is greater (in magnitude) than pump B flow increase rate 264B, the total flow rate 132 continues to drop until pump A loses all flow rate 130A (i.e., between $T_1$ and $T_2$). After pump A loses all flow rate 130A (at $T_2$), pump B flow increase rate 266 continues until $T_3$ when total flow rate 132 again matches the initial flow rate prior to $T_1$.

As a drop in the total flow rate 132 may not satisfy the constraints of a pump system, the example of FIG. 5A may be undesirable. Accordingly, as a comparison shown in FIG. 5B, the same pump system is modified to produce a constant total flow rate 132 during the transitions of pumps.

—FIG. 5B—

Figure 5B:
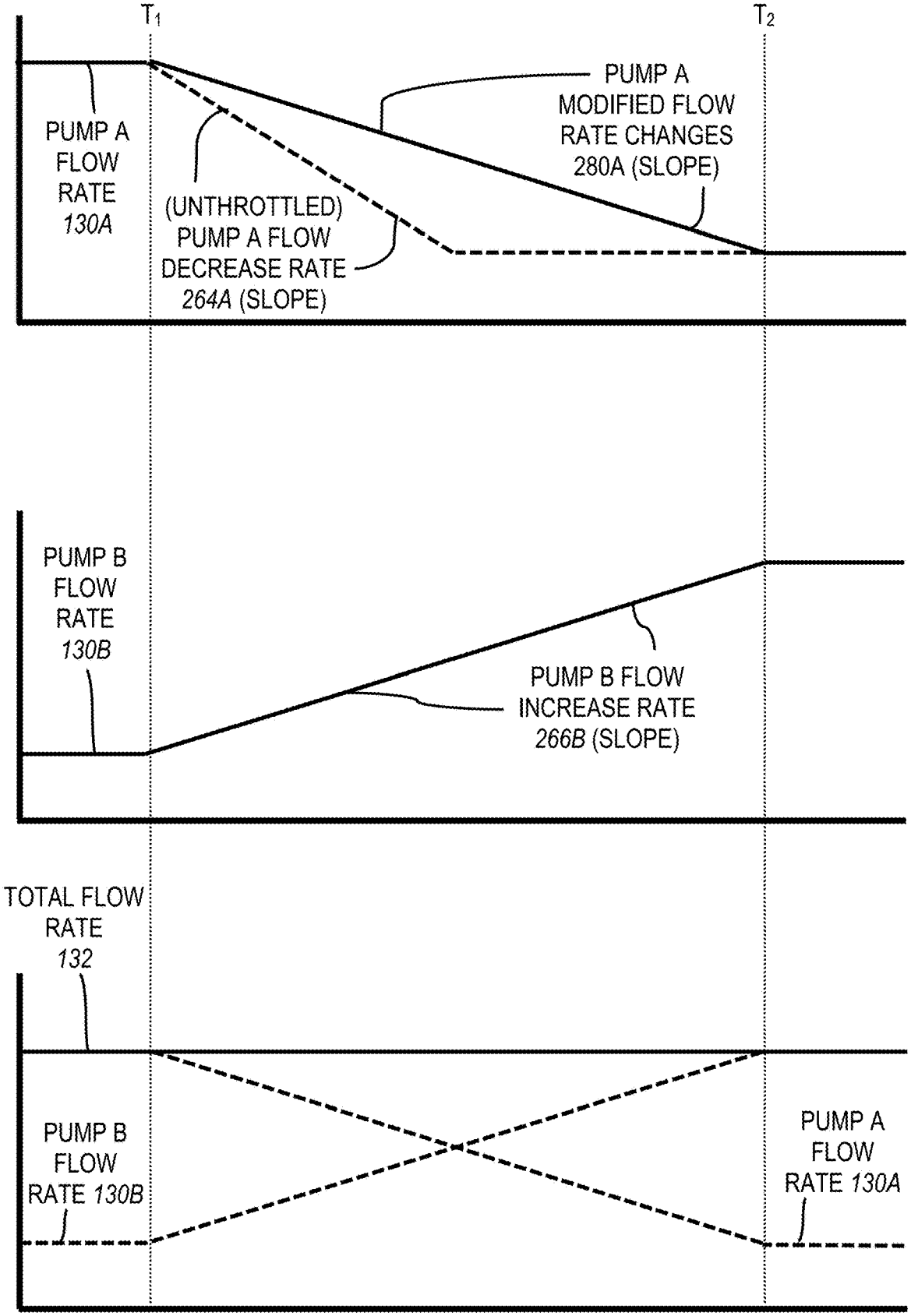
FIG. 5B is three charts of example flow rates for a pump system.

FIG. 5B is three charts of example flow rates for a pump system. For each depicted chart, the horizontal axis represents time, and the vertical axis represents flow rate 130. Each of the charts shows one or more pump(s) change in flow rate 130 over the same time period (the horizontal axis) and are only separated vertically for clarity (as different charts).

In the example of FIG. 5B, consider a scenario where pump A (corresponding to the top chart) is powered down while pump B (corresponding to the middle chart) is powered on. Pump A and pump B both have the same maximum flow rate 130, and pump B will be used to replace the flow rate provided by pump A.

The upper-most chart shows flow rate 130A for pump A. Initially (from the vertical axis to $T_1$), flow rate 130A is constant. At $T_1$, power is controllably reduced to regulate the decrease in flow rate 130A (as modified flow rate changes 280A) to match the change in flow rate 130B from pump B. Accordingly, information handling system calculates pump A modified flow rate changes 280A to match the magnitude of pump B flow increase rate 266B. Thus, flow rate 130A from pump A decreases more slowly than the unregulated pump A flow decrease rate 264A (shown as a dotted line).

The middle chart shows flow rate 130B for pump B. Initially (from the vertical axis to $T_1$), flow rate 130B is constant. At $T_1$, power is provided to pump B. As frictional forces, gravity of the upstream fluid, and stationary momentum of the fluid have to be overcome, pump B begins to increase flow rate 130B at flow increase rate 266B. Notably, the magnitude of the slope of flow increase rate 266B matches the magnitude of pump A modified flow rate changes 280A (the magnitudes of the slopes are equal). Consequently, the increase in flow rate 130B from pump B counteracts the loss in flow rate A 130A from pump A.

The bottom chart shows the total flow rate 132 of the pump system over time. At all times (before $T_1$, from $T_1$ to $T_2$, and after $T_2$) total flow rate 132 remains constant. As pump A modified flow rate changes 280A is controlled to match (the negative slope) of the uncontrolled pump B flow increase rate 266B, the total flow rate remains constant. Accordingly, although pump A is entirely powered down and pump B is entirely powered on, such a transition may not be noticeable downstream as the flow is uninterrupted and unchanging.

As there is no drop (or increase) in the total flow rate 132, the shown transition of pumps satisfies the constraints of a pumping system which requires a total flow rate 132 to remain within a specified window.

—FIG. 5C—

Figure 5C:
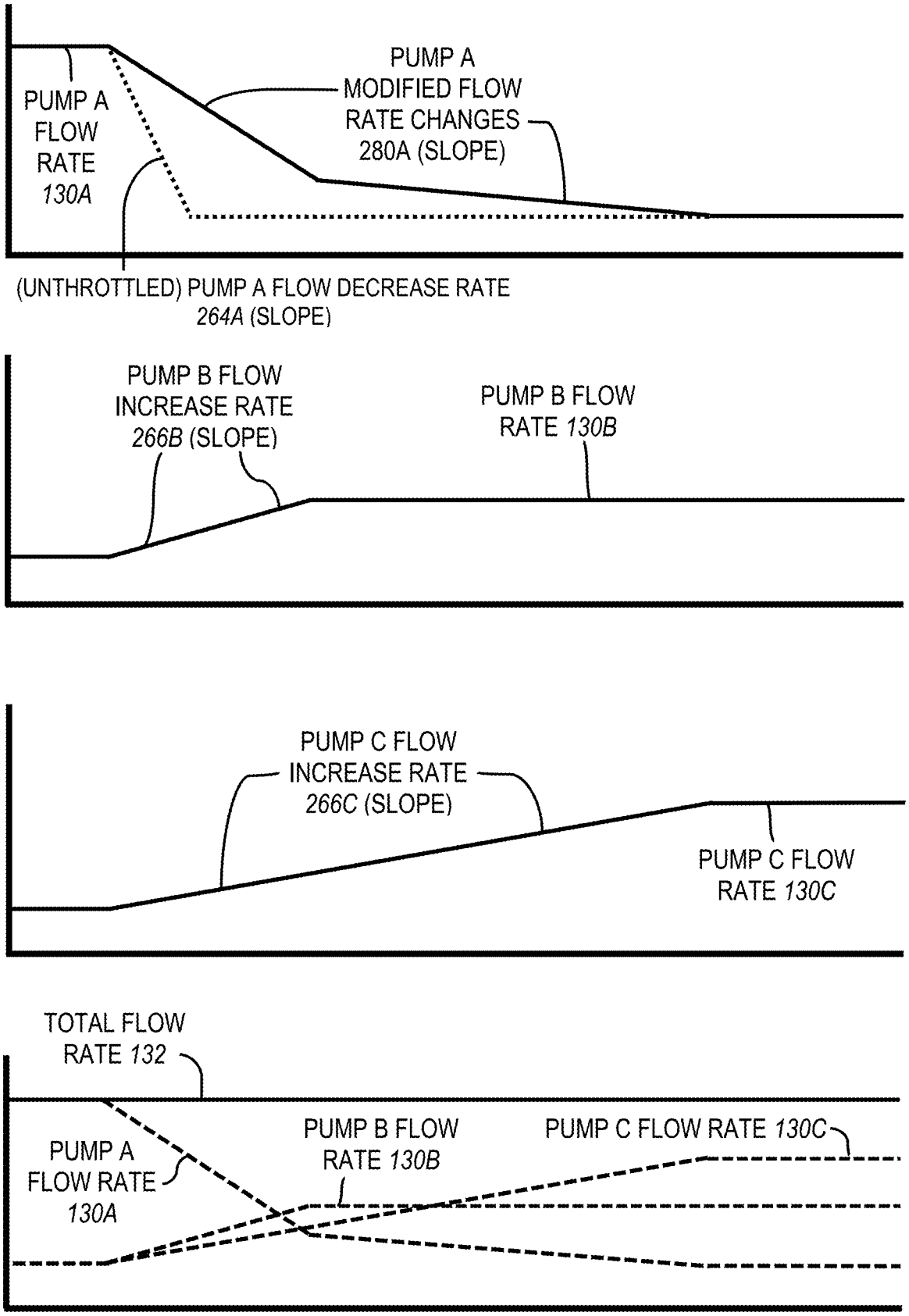
FIG. 5C is four charts of example flow rates for a pump system.

FIG. 5C is four charts of example flow rates for a pump system. For each depicted chart, the horizontal axis represents time, and the vertical axis represents flow rate 130. Each of the charts shows one or more pump(s) change in flow rate 130 over the same time period (the horizontal axis) and are only separated vertically for clarity (as different charts).

In the example of FIG. 5C, consider a scenario where pump A (corresponding to the top chart) is powered down while pump B (corresponding to the second chart) and pump C (corresponding to the third chart) are powered on. Pump B has a flow rate 130B that is one-third that of pump A (flow rate 130A). Pump C has a flow rate 130C that is two-thirds of that of pump A (flow rate 130A). Accordingly, the summation of pump B flow rate 130B and pump C flow rate 130C equal that of pump A flow rate 130A. Pump B and pump C may be used to replace the flow rate of pump A.

The upper-most chart shows flow rate 130A for pump A. Pump A flow decrease rate 264A is shown as a dotted line and provides a visual representation of the unthrottled flow decrease rate 264A of pump A (if not regulated by an information handling system). However, an information handling system is present (not shown) that forces pump A to change pump A flow rate 130A as specified by modified flow rate changes 280A.

Initially flow rate 130A is constant (from the vertical axis to the right). When flow rate 130A begins to decrease, flow rate 130A is controlled to decrease at modified flow rate changes 280A, which is slower (not as steep) as (unthrottled) pump A flow decrease rate 264A. Part of the way through the decrease, pump a modified flow rate changes 280 causes pump A to decrease flow rate 130A at an even slower rate than (with a less-steep slope) until flow rate 130A falls to 0.

The second chart (second from the top) shows flow rate 130B for pump B. Pump B has only one-third the flow rate (130B) of pump A flow rate 130A. Accordingly, assuming a comparable flow increase rate 266B, it does not take as long for pump B to achieve its maximum flow rate 130C as pump C.

The third chart (third from the top, second from the bottom) shows flow rate 130C for pump C. Pump C has two-thirds the flow rate (130C) of pump A flow rate 130A. Accordingly, compared to pump B, pump C takes approximately twice as long to reach the maximum flow rate 130C.

The bottom chart shows the total flow rate 132 of the pump system over time. At all times total flow rate 132 remains constant. While pump B flow rate 130B is undergoing flow increase rate 266B, pump C flow rate C 130C is also undergoing pump C flow increase rate C 266C. Thus, this initial portion of pump A modified flow rate changes 280A is a steeper slope that equals (in magnitude) the sum of pump B flow increase rate 266B and pump C flow increase rate 266C.

After pump B achieves its full flow rate B 130B, pump C continues to increase flow rate 130C. Thus, an information handling system control pump A modified flow rate changes

280A to slow down to match the magnitude of pump C flow increase rate (instead of the sum of pump B flow increase rate 266B and pump C flow increase rate 266C). Total flow rate 132 remains constant as the total changes in flow rates 130 "cancel out".

As there is no drop (or increase) in the total flow rate 132, the shown transition of pumps satisfies the constraints of a pumping system which requires a total flow rate 132 to remain within a specified window.

—Solutions and Improvements—

The methods and systems described above are an improvement over the current technology as the methods and systems described herein provide for controlling the changes in flow rate of pumps, in a multi-pump system, so that a relatively constant total flow rate is maintained when transitioning pumps.

In conventional pump systems, if a pump is powered off at the same time another pump is powered on, the total flow rate will tend to drop as pumps lose their flow rate more quickly than gaining flow rate when powering on. In fracturing environments, where constant total flow rate must be maintained between minimum and maximum thresholds, these conventional systems fail to allow for a relatively constant total flow rate.

Accordingly, as described herein, systems and methods for controlling the rate at which pumps power off (or power on) are provided. That is, instead of abruptly cutting power to a working pump, power may be gradually reduced in order to maintain a flow decrease rate equal to the flow increase rate of a pump powering on. Further, such a system may be used in systems with two or more pumps operating simultaneously (e.g., four pumps may be powered on to replace the decreasing flow rate of two pumps being powered off).

Further, additional methods described herein allow for the change in flow rate to be dynamic throughout the transition. As an example, if multiple pumps are powering on at different flow increase rates, one (or more) of those pumps may achieve their maximum flow rate while others continue to increase their flow rate (at a slower rate for a longer duration of time). Accordingly, the pumps being powered down may be throttled at different rates during the transition process to match any changes in the total flow increase rate provided by the pumps powering on.

—Statements—

The systems and methods may comprise any of the various features disclosed herein, comprising one or more of the following statements.

Statement 1: A method for controlling changes in pump flow rates, comprising: identifying a first plurality of pumps to go offline; calculating a total flow decrease rate based on the first plurality of pumps; identifying a second plurality of pumps to go online; calculating a total flow increase rate based on the second plurality of pumps; making a determination that a difference between the total flow decrease rate and the total flow increase rate exceeds a flow rate threshold; and implementing pump throttling based on the determination.

Statement 2: The method of statement 1, wherein the total flow decrease rate is greater than the total flow increase rate.

Statement 3: The method of statement 2, wherein the pump throttling is applied to the first plurality of pumps to go offline.

Statement 4: The method of statement 3, wherein the pump throttling comprises reducing electrical power provided to the first plurality of pumps.

Statement 5: The method of statements 3-4, wherein the pump throttling comprises reducing a flow of fuel provided to the first plurality of pumps.

Statement 6: The method of statements 1-5, wherein the total flow increase rate is greater than the total flow decrease rate.

Statement 7: The method of statement 6, wherein the pump throttling is applied to the second plurality of pumps to go online.

Statement 8: The method of statements 1-7, wherein identifying the first plurality of pumps comprises: identifying a first plurality of pump statuses respectively associated with each pump of the first plurality of pumps, wherein each of the first plurality of pump statuses indicates that each pump of the first plurality of pumps is going to go offline.

Statement 9: The method of statement 8, wherein identifying the second plurality of pumps comprises: identifying a second plurality of pump statuses respectively associated with each pump of the second plurality of pumps, wherein each of the second plurality of pump statuses indicates that each pump of the second plurality of pumps is going to go offline.

Statement 10: A pump system, comprising: a first pump; a second pump; a third pump; and an information handling system, wherein the information handling system is configured to perform a method for controlling changes in flow rates, comprising: identifying that the first pump and the second pump are designated to go offline; identifying that the third pump is designated to go online; calculating a total flow decrease rate based on the first pump and the second pump; calculating a total flow increase rate based on the third pump; making a determination that a difference between the total flow decrease rate and the total flow increase rate exceeds a flow rate threshold; and implementing pump throttling based on the determination.

Statement 11: The pump system of statement 10, wherein calculating the total flow decrease rate is based on a first flow rate associated with the first pump and a second flow rate associated with the second pump.

Statement 12: The pump system of statement 11, wherein the total flow decrease rate is a sum of the first flow rate and the second flow rate.

Statement 13: The pump system of statements 10-12, wherein the total flow decrease rate is greater than the total flow increase rate.

Statement 14: The pump system of statement 13, wherein the pump throttling is applied to the first pump and the second pump.

Statement 15: The pump system of statements 10-14, wherein the total flow increase rate is greater than the total flow decrease rate.

Statement 16: The pump system of statements 13-15, wherein the pump throttling is applied to the third pump.

Statement 17: A system, comprising: a first pump operatively connected to a first pump controller; a second pump operatively connected to a second pump controller; a processor operatively connected to the first pump controller and the second pump controller, wherein the processor is configured to: perform a lookup, in pump transition data, to identify a pump transition data entry, wherein the pump transition data entry comprises a total flow decrease rate and a total flow increase rate; make a determination that a magnitude of the total flow decrease rate is greater than a magnitude of the total flow increase rate; generate modified flow rate changes, based on the determination; and initiate a throttled decrease in power to the first pump, as specified in the modified flow rate changes, wherein the first pump is designated to go offline in the pump transition data entry.

Statement 18: The system of statement 17, wherein the processor initiates the throttled decrease in power by sending a first command to the first pump controller.

Statement 19: The system of statement 18, wherein the processor is further configured to: initiate providing power to the second pump, wherein the second pump is designated to go online in the pump transition data entry.

Statement 20: The system of statement 19, wherein the processor initiates providing power to the second pump by sending a second command to the second pump controller.

—General Notes—

As it is impracticable to disclose every conceivable embodiment of the technology described herein, the figures, examples, and description provided herein disclose only a limited number of potential embodiments. A person of ordinary skill in the art would appreciate that any number of potential variations or modifications may be made to the explicitly disclosed embodiments, and that such alternative embodiments remain within the scope of the broader technology. Accordingly, the scope should be limited only by the attached claims. Further, the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. Certain technical details, known to people of ordinary skill in the art, may be omitted for brevity and to avoid cluttering the description of the novel aspects.

For further brevity, descriptions of similarly named components may be omitted if a description of that similarly named component exists elsewhere in the application. Accordingly, any component described with respect to a specific figure may be equivalent to one or more similarly named components shown or described in any other figure, and each component incorporates the description of every similarly named component provided in the application (unless explicitly noted otherwise). A description of any component is to be interpreted as an optional embodiment—which may be implemented in addition to, in conjunction with, or in place of an embodiment of a similarly-named component described for any other figure.

—Lexicographical Notes—

As used herein, adjective ordinal numbers (e.g., first, second, third, etc.) are used to distinguish between elements and do not create any particular ordering of the elements. As an example, a "first element" is distinct from a "second element", but the "first element" may come after (or before) the "second element" in an ordering of elements. Accordingly, an order of elements exists only if ordered terminology is expressly provided (e.g., "before", "between", "after", etc.) or a type of "order" is expressly provided (e.g., "chronological", "alphabetical", "by size", etc.). Further, use of ordinal numbers does not preclude the existence of other elements. As an example, a "table with a first leg and a second leg" is any table with two or more legs (e.g., two legs, five legs, thirteen legs, etc.). A maximum quantity of elements exists only if express language is used to limit the upper bound (e.g., "two or fewer", "exactly five", "nine to twenty", etc.). Similarly, singular use of an ordinal number does not imply the existence of another element. As an example, a "first threshold" may be the only threshold and therefore does not necessitate the existence of a "second threshold".

As used herein, the word "data" may be used as an "uncountable" singular noun—not as the plural form of the singular noun "datum". Accordingly, throughout the application, "data" is generally paired with a singular verb (e.g., "the data is modified"). However, "data" is not redefined to mean a single bit of digital information. Rather, as used herein, "data" means any one or more bit(s) of digital information that are grouped together (physically or logically). Further, "data" may be used as a plural noun if context provides the existence of multiple "data" (e.g., "the two data are combined").

As used herein, the term "operative connection" (or "operatively connected") means the direct or indirect connection between devices that allows for interaction in some way (e.g., via the exchange of information). For example, the phrase 'operatively connected' may refer to a direct connection (e.g., a direct wired or wireless connection between devices) or an indirect connection (e.g., multiple wired and/or wireless connections between any number of other devices connecting the operatively connected devices).

As used herein, indefinite articles "a" and "an" mean "one or more". That is, the explicit recitation of "an" element does not preclude the existence of a second element, a third element, etc. Further, definite articles (e.g., "the", "said") mean "any one of" (the "one or more" elements) when referring to previously introduced element(s). As an example, there may exist "a processor", where such a recitation does not preclude the existence of any number of other processors. Further, "the processor receives data, and the processor processes data" means "any one of the one or more processors receives data" and "any one of the one or more processors processes data". It is not required that the same processor both (i) receive data and (ii) process data. Rather, each of the steps ("receive" and "process") may be performed by different processors.

What is claimed is:

1. A method for controlling changes in pump flow rates, comprising:

identifying a first plurality of pumps to go offline;

calculating a total flow decrease rate based on the first plurality of pumps, wherein the total flow decrease rate is a negative rate of change of a flow rate of the first plurality of pumps;

identifying a second plurality of pumps to go online;

calculating a total flow increase rate based on the second plurality of pumps, wherein the total flow increase rate is a positive rate of change of a flow rate of the second plurality of pumps;

making a determination that a difference between the total flow decrease rate and the total flow increase rate exceeds a flow rate threshold; and implementing pump throttling based on the determination.

2. The method of claim 1, wherein the total flow decrease rate is greater than the total flow increase rate.

3. The method of claim 2, wherein the pump throttling is applied to the first plurality of pumps going offline to control the total flow decrease rate.

4. The method of claim 3, wherein the pump throttling comprises reducing electrical power provided to the first plurality of pumps.

5. The method of claim 3, wherein the pump throttling comprises reducing a flow of fuel provided to the first plurality of pumps.

6. The method of claim 1, wherein the total flow increase rate is greater than the total flow decrease rate.

7. The method of claim 6, wherein the pump throttling is applied to the second plurality of pumps going online to control the total flow increase rate.

8. The method of claim 1, wherein identifying the first plurality of pumps comprises:

identifying a first plurality of pump statuses respectively associated with each pump of the first plurality of pumps, wherein each of the first plurality of pump statuses indicates that each pump of the first plurality of pumps is going to go offline.

9. The method of claim 8, wherein identifying the second plurality of pumps comprises:

identifying a second plurality of pump statuses respectively associated with each pump of the second plurality of pumps, wherein each of the second plurality of pump statuses indicates that each pump of the second plurality of pumps is going to go online.

10. A pump system, comprising:

a first pump;

a second pump;

a third pump; and an information handling system, wherein the information handling system is configured to perform a method for controlling changes in flow rates, comprising:

identifying that the first pump and the second pump are designated to go offline;

identifying that the third pump is designated to go online;

calculating a total flow decrease rate based on the first pump going offline and the second pump going offline, wherein the total flow decrease rate is a negative rate of change of a flow rate of the first pump and the second pump;

calculating a total flow increase rate based on the third pump going online, wherein the total flow increase rate is a positive rate of change of a flow rate of the third pump;

making a determination that a difference between the total flow decrease rate and the total flow increase rate exceeds a flow rate threshold; and implementing pump throttling based on the determination.

11. The pump system of claim 10, wherein calculating the total flow decrease rate is based on a first flow rate associated with the first pump and a second flow rate associated with the second pump.

12. The pump system of claim 11, wherein the total flow decrease rate is a sum of the first flow rate and the second flow rate.

13. The pump system of claim 10, wherein the total flow decrease rate is greater than the total flow increase rate.

14. The pump system of claim 13, wherein the pump throttling is applied to the first pump and the second pump.

15. The pump system of claim 10, wherein the total flow increase rate is greater than the total flow decrease rate.

16. The pump system of claim 15, wherein the pump throttling is applied to the third pump.

17. A system, comprising:

a first pump operatively connected to a first pump controller;

a second pump operatively connected to a second pump controller; and a processor operatively connected to the first pump controller and the second pump controller, wherein the processor is configured to:

perform a lookup, in pump transition data, to identify a pump transition data entry, wherein the pump transition data entry comprises a total flow decrease rate and a total flow increase rate, wherein the total flow decrease rate is a negative rate of change of a flow rate of the first pump, and wherein the total flow increase rate is a positive rate of change of a flow rate of the second pump;

make a determination that a magnitude of the total flow decrease rate is greater than a magnitude of the total flow increase rate;

generate modified flow rate changes, based on the determination; and initiate a throttled decrease in power to the first pump, as specified in the modified flow rate changes, wherein the first pump is designated to go offline in the pump transition data entry.

18. The system of claim 17, wherein the processor initiates the throttled decrease in power by sending a first command to the first pump controller.

19. The system of claim 18, wherein the processor is further configured to:

initiate providing power to the second pump, wherein the second pump is designated to go online in the pump transition data entry.

20. The system of claim 19, wherein the processor initiates providing power to the second pump by sending a second command to the second pump controller.

* * * * *